US010894416B2

(12) United States Patent
Nakai et al.

(10) Patent No.: US 10,894,416 B2
(45) Date of Patent: Jan. 19, 2021

(54) INKJET PRINTING APPARATUS AND INK FILLING METHOD

(71) Applicant: CANON KABUSHIKI KAISHA, Tokyo (JP)

(72) Inventors: Hiroshi Nakai, Sagamihara (JP); Noriko Sato, Kawasaki (JP); Takahiro Kiuchi, Fuchu (JP); Takashi Sasaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/589,320

(22) Filed: Oct. 1, 2019

(65) Prior Publication Data

US 2020/0108619 A1 Apr. 9, 2020

(30) Foreign Application Priority Data

Oct. 5, 2018 (JP) ..... 2018-189651

(51) Int. Cl.
*B41J 2/175* (2006.01)
*B41J 2/18* (2006.01)
*B41J 2/165* (2006.01)

(52) U.S. Cl.
CPC ..... *B41J 2/17509* (2013.01); *B41J 2/16511* (2013.01); *B41J 2/17556* (2013.01); *B41J 2/17596* (2013.01); *B41J 2/18* (2013.01); *B41J 2002/16514* (2013.01); *B41J 2202/12* (2013.01)

(58) Field of Classification Search
CPC ..... B41J 2/17509; B41J 2/16511; B41J 2/17556; B41J 2/17596; B41J 2/18
See application file for complete search history.

(56) References Cited

U.S. PATENT DOCUMENTS

| | | | | |
|---|---|---|---|---|
| 4,636,844 | A | 1/1987 | Sasaki | |
| 4,639,747 | A | 1/1987 | Sakurada et al. | |
| 4,682,186 | A | 7/1987 | Sasaki et al. | |
| 4,682,216 | A | 7/1987 | Sasaki et al. | |
| 4,714,964 | A | 12/1987 | Sasaki | |
| 4,731,662 | A | 3/1988 | Udagawa et al. | |
| 6,529,225 | B1 | 3/2003 | Shiraiwa et al. | |
| 6,867,879 | B1 | 3/2005 | Sasaki et al. | |
| 6,891,556 | B2 | 5/2005 | Sasaki et al. | |
| 9,272,543 | B2 | 3/2016 | Ohyama et al. | |
| 10,406,838 | B2 | 9/2019 | Ohashi et al. | |
| 2011/0050793 | A1* | 3/2011 | Kumagai | B41J 2/17596 347/22 |
| 2018/0056662 | A1* | 3/2018 | Shinoda | B41J 2/175 |
| 2018/0236791 | A1 | 8/2018 | Ohashi et al. | |
| 2019/0299589 | A1 | 10/2019 | Kiuchi et al. | |
| 2020/0016911 | A1 | 1/2020 | Ohashi et al. | |

FOREIGN PATENT DOCUMENTS

| | | | |
|---|---|---|---|
| JP | 2008-254343 | A | 10/2008 |
| JP | 2010-208152 | A | 9/2010 |
| JP | 2012-096492 | A | 5/2012 |

* cited by examiner

*Primary Examiner* — Lamson D Nguyen
(74) *Attorney, Agent, or Firm* — Venable LLP

(57) ABSTRACT

An objective of the present invention is to provide an inkjet printing apparatus and an ink filling method capable of restraining a decrease in its availability. For that purpose, in a case where a predetermined negative pressure (determination pressure) is not reached within a predetermined time (determination time) in normal filling operation (first filling operation), it is assumed that a leakage occurs in a cap member, and second filling operation is performed.

13 Claims, 15 Drawing Sheets

INKJET PRINTING APPARATUS AND INK FILLING METHOD

BACKGROUND OF THE INVENTION

Field of the Invention

The present invention relates to an inkjet printing apparatus and an ink filling method that fills a print head with ink by placing an inside of the print head under a negative pressure, with a cap caused to abut against an ejection port surface that is provided with ejection ports of the print head for ejecting ink.

Description of the Related Art

Japanese Patent Laid-Open No. 2010-208152 discloses a method for filling a print head in an inkjet printing apparatus with ink. The inkjet printing apparatus has a configuration with a main tank and the print head between which a sub tank is provided, where the sub tank is provided with a valve. According to Japanese Patent Laid-Open No. 2010-208152, an inside of the print head is depressurized by depressurizing an inside of a cap with a pump, with the print head and the cap caused to abut against each other in a state where the valve is closed to cut off a channel between the sub tank and the print head. The valve provided in the sub tank is thereafter released, so as to fill the print head with liquid from the sub tank.

However, in the method disclosed in Japanese Patent Laid-Open No. 2010-208152, a relatively long time is taken to depressurize sufficiently between the print head and near the sub tank. The method in which every ink supply involves such depressurizing to supply ink consumes time for filling.

SUMMARY OF THE INVENTION

Hence, the present invention provides an inkjet printing apparatus and an ink filling method capable of efficient filling with ink.

Therefore, an inkjet printing apparatus comprising: a storage unit capable of storing ink; a print head having an ejection port surface on which ejection ports for ejecting ink supplied from the storage unit are formed; a supply channel for supplying ink from the storage unit to the print head; a cap unit capable of covering the ejection port surface; a depressurizing unit connected to the cap unit and capable of depressurizing a space formed between the ejection port surface and the cap unit in a state where the cap unit covers the ejection port surface; a channel connecting the cap unit and the depressurizing unit; a pressure detection unit capable of detecting a pressure of an inside of at least one of the supply channel including the print head and the channel; a valve unit provided in the channel and capable of opening and closing of the channel; and a control unit capable of performing: a first filling operation for filling the print head with ink from the storage unit by driving the depressurizing unit with the cap unit covering the ejection port surface and the valve unit being opened; and a second filling operation in which the depressurizing unit is driven, with the ejection port surface covered with the cap unit and the valve unit being closed, and in a case where a pressure of an inside of the channel reaches a second predetermined negative pressure value, the print head is filled with ink from the storage unit by opening the valve unit.

According to the present invention, an inkjet printing apparatus and an ink filling method capable of efficient filling with ink can be provided.

Further features of the present invention will become apparent from the following description of exemplary embodiments with reference to the attached drawings.

DESCRIPTION OF THE EMBODIMENTS

An embodiment of the present invention will be described below with reference to the accompanying drawings.

Figure 1:
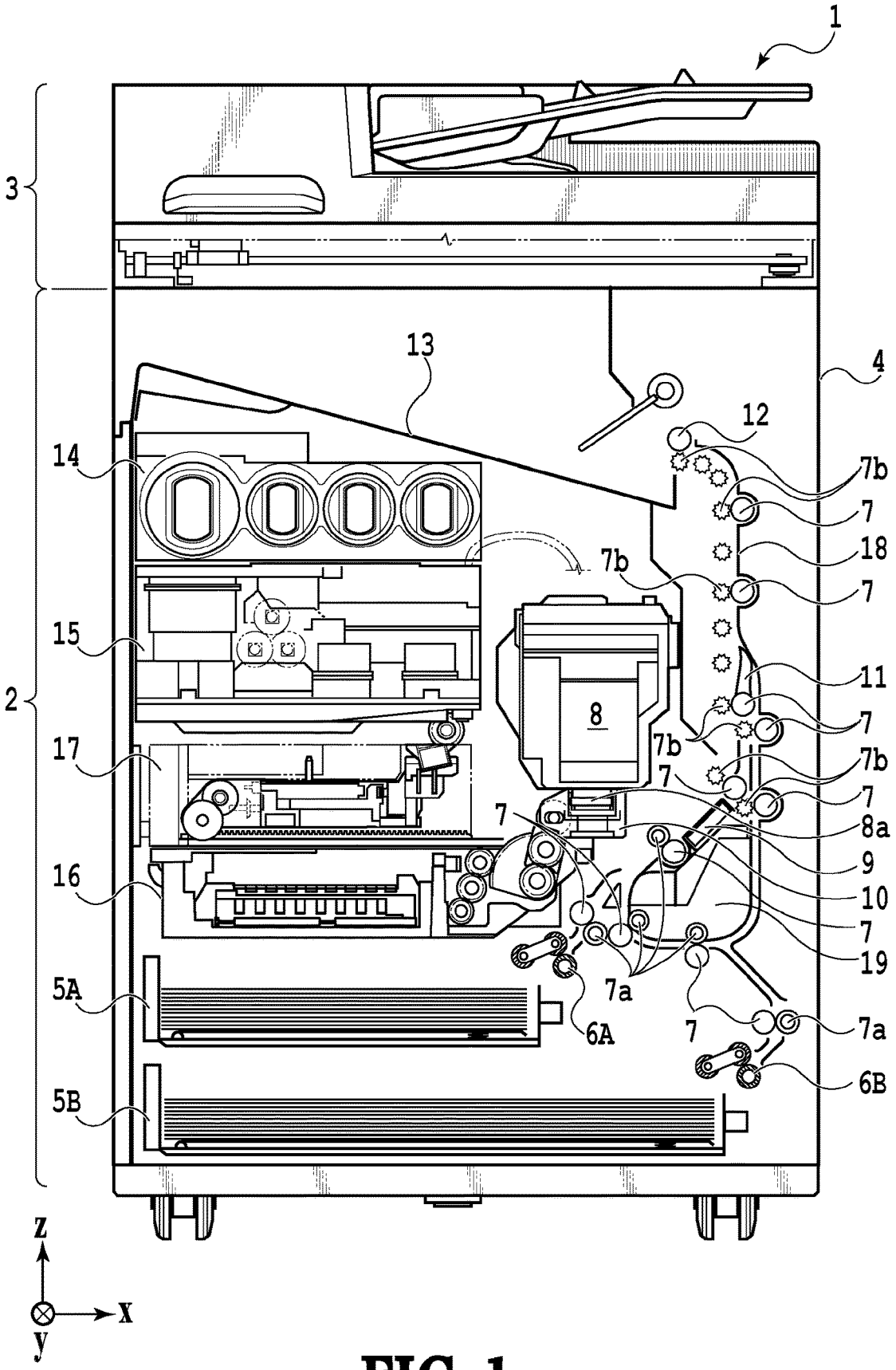
FIG. 1 is a diagram of a printing apparatus being in a standby state.

FIG. 1 is an internal configuration diagram of an inkjet printing apparatus 1 (hereinafter, referred to as a printing apparatus 1) that is used in the present embodiment. In the diagram, a direction x indicates a horizontal direction, a direction y (a direction perpendicular to the paper) indicates a direction in which ejection ports are arranged in a print head 8 described below, and a direction z indicates a vertical direction.

The printing apparatus 1 is a multifunctional peripheral including a printing section 2 and a scanner section 3 and is capable of executing various kinds of processes relating to print operation and reading operation in conjunction with the printing section 2 and the scanner section 3 while the printing section 2 and the scanner section 3 operate individually or in association with each other. The scanner section 3 includes an automatic document feeder (ADF) and a flatbed scanner (FBS), and is capable of reading an original document that is automatically fed by the ADF and reading (scanning) an original document placed on an original document plate. Although the present embodiment is the multifunctional peripheral including both the printing section 2 and the scanner section 3 but may be in a form without the scanner section 3. FIG. 1 illustrates the printing apparatus 1 being in a standby state, where the printing apparatus 1 performs neither the print operation nor the reading operation.

In the printing section 2, in a bottom portion positioned at a vertically lower part of a housing 4, a first cassette 5A and a second cassette 5B both for containing print media (cut sheets) S are installed detachably. The first cassette 5A contains relatively small print media of a size up to an A4-size paper stacked flat, and the second cassette 5B contains relatively large print media of a size up to an A3-size paper stacked flat. In a proximity to the first cassette 5A, a first feeding unit 6A for separating and feeding the contained print medium one by one is provided. Similarly, in proximity to the second cassette 5B, a second feeding unit 6B is provided. When the print operation is performed, one of the cassettes is selected, from which a print medium S is fed.

Conveyance rollers 7, a discharge roller 12, pinch rollers 7*a*, spur rollers 7*b*, a guide 18, an inner guide 19, and a flapper 11 serve as a conveyance mechanism for leading a print medium S in a predetermined direction. The conveyance rollers 7 are driving rollers that are arranged on an upstream side and a downstream side of the print head 8 and driven by conveyance motors (not illustrated). The pinch rollers 7*a* are follower rollers each of which is configured to rotate while nipping a print medium S with the conveyance roller 7. The discharge roller 12 is a driving roller that is arranged on a downstream side of the conveyance rollers 7 and configured to be driven by a conveyance motor (not illustrated). The spur rollers 7*b* sandwich and convey a print medium S together with the conveyance rollers 7 and the discharge roller 12 arranged on a downstream side of the print head 8.

The guide 18 is provided in a conveyance route of a print medium S and configured to guide the print medium S in a predetermined direction. The inner guide 19 has a curved side surface made of a member extending in the direction y and is configured to guide a print medium S along the side surface. The flapper 11 is a member for switching a direction in which a print medium S is conveyed during double-sided print operation. A discharge tray 13 is a tray for retaining loaded print media S that are discharged by the discharge roller 12 after completion of the print operation.

The print head 8 in the present embodiment is a chromatic color inkjet print head of a full-line type, in which a plurality of ejection ports configured to eject ink according to printing data are arranged along the direction y in FIG. 1 by a number corresponding to a width of a print medium S. That is, the print head 8 is configured to be able to eject inks of a plurality of colors. When the print head 8 is at a stand-by position, an ejection port surface 8*a* of the print head 8 faces vertically downward and is capped by (covered with) a cap unit 10 as illustrated in FIG. 1. During the print operation, an orientation of the print head 8 is changed by a print controller 202 described below so that the ejection port surface 8*a* faces a platen 9. The platen 9 is made of a plate extending in the direction y and configured to support a print medium S being subjected to the print operation by the print head 8 from a back side of the print medium S. Movement of the print head 8 from the stand-by position to a printing position will be described below in detail.

Ink reservoir units 14 are configured to retain (capable of retaining) inks of four colors to be supplied to the print head 8, respectively. Ink supply units 15 are each provided in a middle of a channel connecting the ink reservoir units 14 and the print head 8 and each configured to adjust a pressure and a flow rate of ink in the print head 8 to within an appropriate range. In the present embodiment, a circular ink supply system is adopted, and the ink supply units 15 are each configured to adjust the pressure of ink supplied to the print head 8 and the flow rate of ink collected from the print head 8 to within an appropriate range.

A maintenance unit 16 includes the cap unit 10 and a wiping unit 17 and is configured to cause the cap unit 10 and the wiping unit 17 to work with a predetermined timing to perform maintenance operation on the print head 8. The maintenance operation will be described below in detail.

Figure 2:
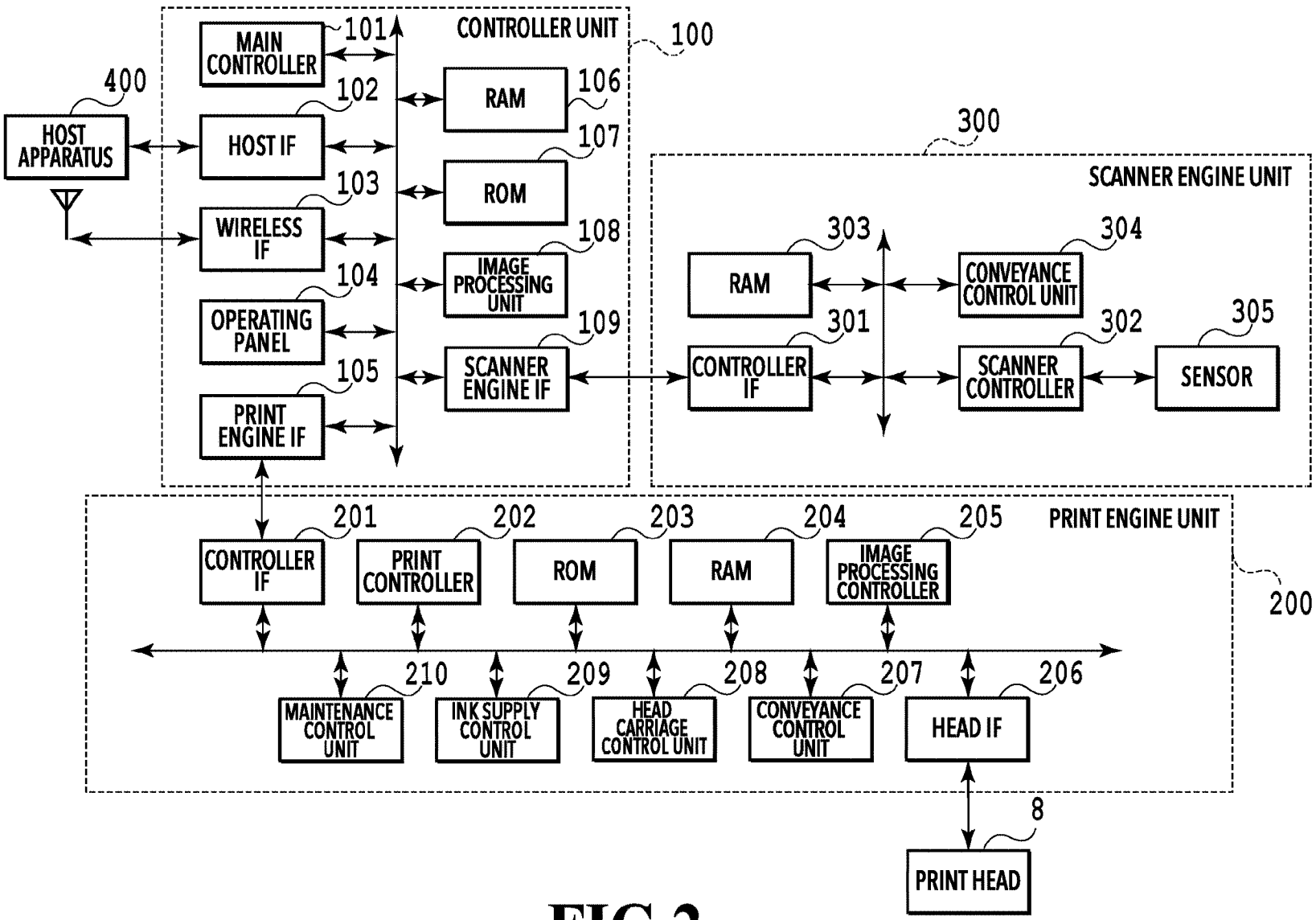
FIG. 2 is a control configuration diagram of the printing apparatus.

FIG. 2 is a block diagram illustrating a control configuration of the printing apparatus 1. The control configuration mainly includes a print engine unit 200 configured to generally control the printing section 2, a scanner engine unit 300 configured to generally control the scanner section 3, and a controller unit 100 configured to generally control the printing apparatus 1 as a whole. A print controller 202 is configured to control different mechanisms of the print engine unit 200 according to instructions from a main controller 101 of the controller unit 100. Different mechanisms of the scanner engine unit 300 are controlled by the main controller 101 of the controller unit 100. The control configuration will be described below in detail.

In the controller unit 100, the main controller 101, which is made up of a CPU, is configured to control the printing apparatus 1 as a whole using a RAM 106 as a work area according to programs and different parameters stored in a ROM 107. For example, upon an input of a print job from a host apparatus 400 via a host I/F 102 or a wireless I/F 103, image data received by an image processing unit 108 is subjected to predetermined image processing according to instructions from the main controller 101. The main controller 101 then transmits the image data subjected to the image processing to the print engine unit 200 via a print engine I/F 105.

The printing apparatus 1 may acquire the image data from the host apparatus 400 through wireless communication or wired communication or may acquire the image data from an external storage apparatus (e.g., a USB memory) connected to the printing apparatus 1. There is no limitation on a communication method used in the wireless communication or the wired communication. Examples of an applicable communication method used for the wireless communication include Wireless Fidelity (Wi-Fi)® and Bluetooth®. Examples of an applicable communication method used for the wired communication include Universal Serial Bus (USB) or the like. In addition, for example, upon an input of a read command from the host apparatus 400, the main controller 101 transmits this command to the scanner section 3 via the scanner engine I/F 109.

An operation panel 104 is a mechanism with which a user makes an input/output to the printing apparatus 1. A user can use the operation panel 104 to give instructions on copying, scanning, or the like, set a print mode, or recognize information on the printing apparatus 1.

In the print engine unit 200, the print controller 202, which is made up of a CPU, is configured to control different mechanisms included in the printing section 2 using a RAM 204 as a work area according to programs and different parameters stored in a ROM 203. Upon receiving different commands or image data via a controller I/F 201, the print controller 202 once saves the commands or the image data in the RAM 204. To make the print head 8 available in the print operation, the print controller 202 converts the image data saved in an image processing controller 205 into print data. Upon creation of print data, the print controller 202 uses the head I/F 206 to cause the print head 8 to execute print operation based on the print data. At this time, the print controller 202 uses the conveyance control portion 207 to drive the feeding units 6A and 6B, the conveyance rollers 7, the discharge roller 12, and the flapper 11 illustrated in FIG. 1 to convey a print medium S. Along with conveying operation of the print medium S, the print operation is executed by the print head 8 according to instructions from the print controller 202, so as to execute print processing.

A head carriage control portion 208 is configured to change an orientation or a position of the print head 8 according to a maintenance state or an operation state of the printing apparatus 1. An ink supply control portion 209 is configured to control the ink supply unit 15 so that a pressure of ink supplied to the print head 8 falls within an appropriate range. A maintenance control portion 210 is configured to control operation of the cap unit 10 and the wiping unit 17 in the maintenance unit 16 when the maintenance operation is performed on the print head 8.

In the scanner engine unit 300, the main controller 101 is configured to control hardware resources of a scanner controller 302 using the RAM 106 as a work area according to programs and different parameters stored in the ROM 107. Different mechanisms included in the scanner section 3 are thereby controlled. For example, by the control of the main controller 101 over the hardware resources of the scanner controller 302 via a controller I/F 301, an original document that is loaded on the ADF by a user is conveyed by a conveyance control portion 304 and read by a sensor 305. The scanner controller 302 then saves the read image data in a RAM 303. The print controller 202 converts the image data acquired as described above into print data, which enables the print head 8 to execute print operation based on image data read by the scanner controller 302.

Figure 3:
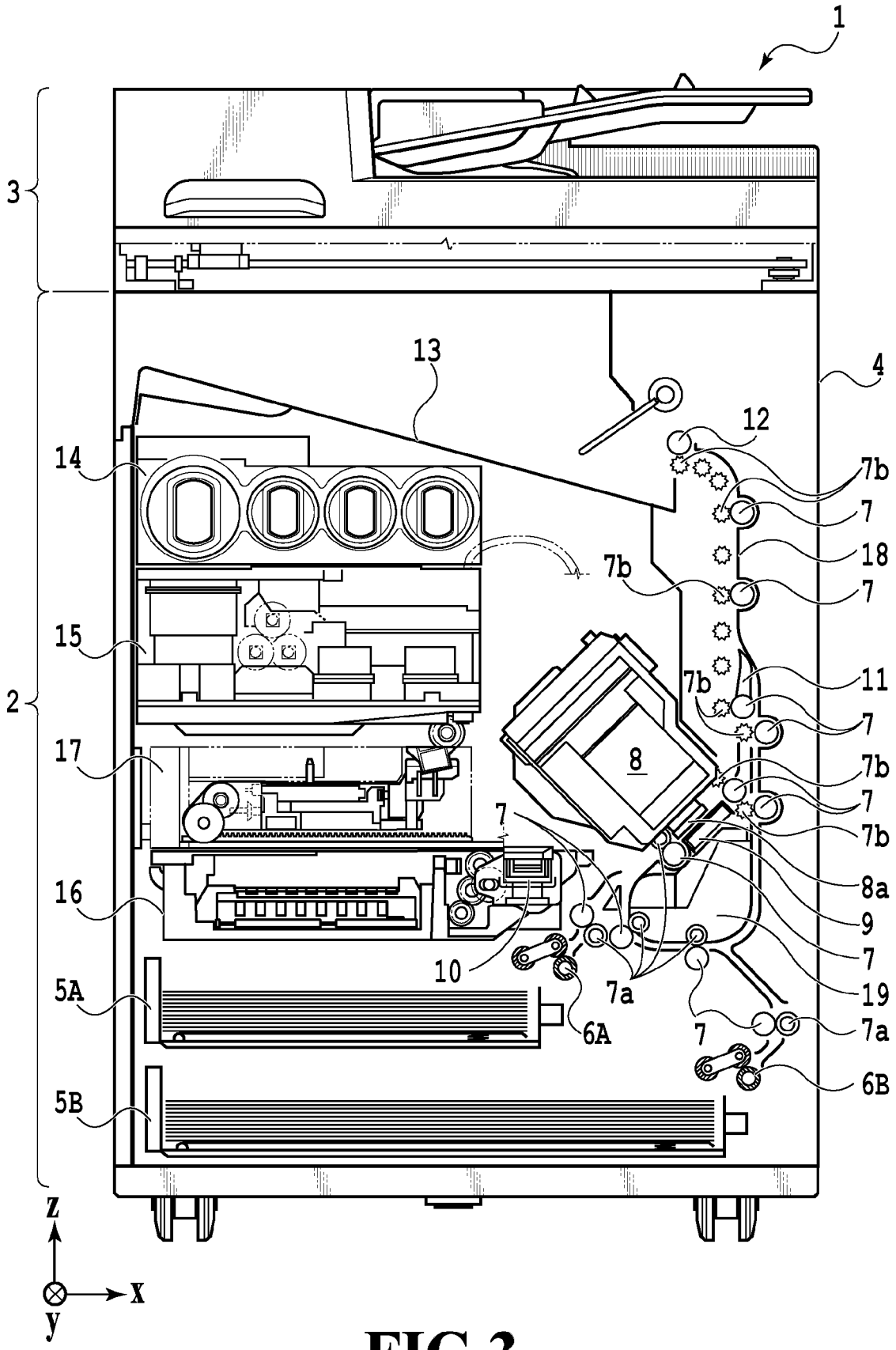
FIG. 3 is a diagram of the printing apparatus being in a print state.

FIG. 3 illustrates the printing apparatus 1 being in a print state. As compared with the standby state illustrated in FIG. 1, the cap unit 10 is separated from the ejection port surface 8*a* of the print head 8, and the ejection port surface 8*a* faces the platen 9. In the present embodiment, a plane of the platen 9 is inclined by about 45 degrees with respect to the horizontal direction, and the ejection port surface 8*a* of the print head 8 in the printing position is also inclined by about 45 degrees with respect to the horizontal direction so that a distance from the platen 9 is kept constant.

To move the print head 8 from the stand-by position illustrated in FIG. 1 to the printing position illustrated in FIG. 3, the print controller 202 uses the maintenance control portion 210 to descend the cap unit 10 to its inoperative position illustrated in FIG. 3. This separates the ejection port surface 8*a* of the print head 8 from the cap member 10*a*. The print controller 202 thereafter uses the head carriage control portion 208 to rotate the print head 8 by 45 degrees while adjusting a height of the print head 8 in the vertical direction, so as to cause the ejection port surface 8*a* face the platen 9. To move the print head 8 from the printing position to the stand-by position after completion of the print operation, the print controller 202 performs a process that is a reverse of the above.

Next, a conveyance route of a print medium S in the printing section 2 will be described. Upon input of a print command, the print controller 202 first uses the maintenance control portion 210 and the head carriage control portion 208 to move the print head 8 to the printing position illustrated in FIG. 3. The print controller 202 thereafter uses the conveyance control portion 207 to drive one of the first feeding unit 6A and the second feeding unit 6B according to the print command, so as to feed the print medium S.

Figure 4C:
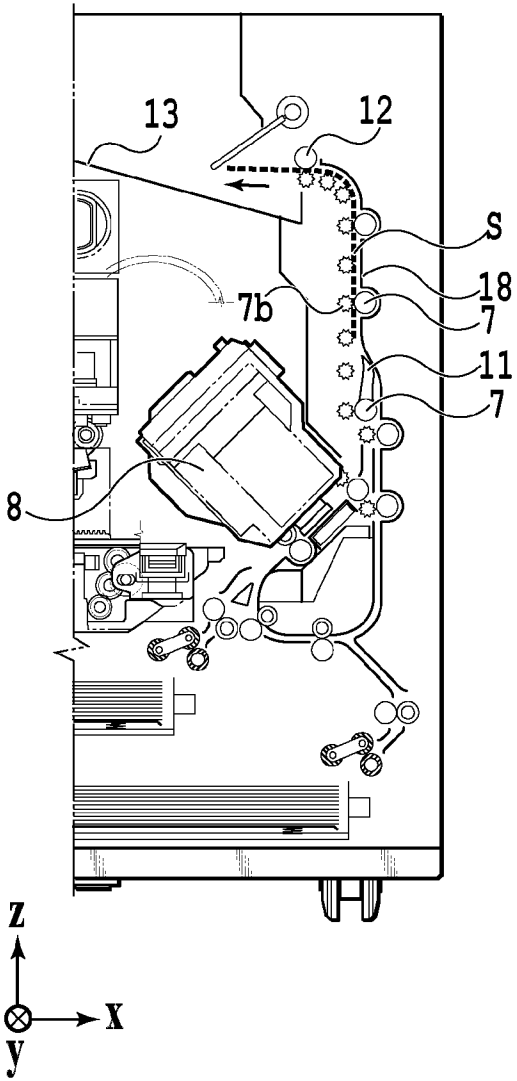
FIG. 4C is a conveyance route diagram of the print medium that is fed from the first cassette.
Figure 4B:
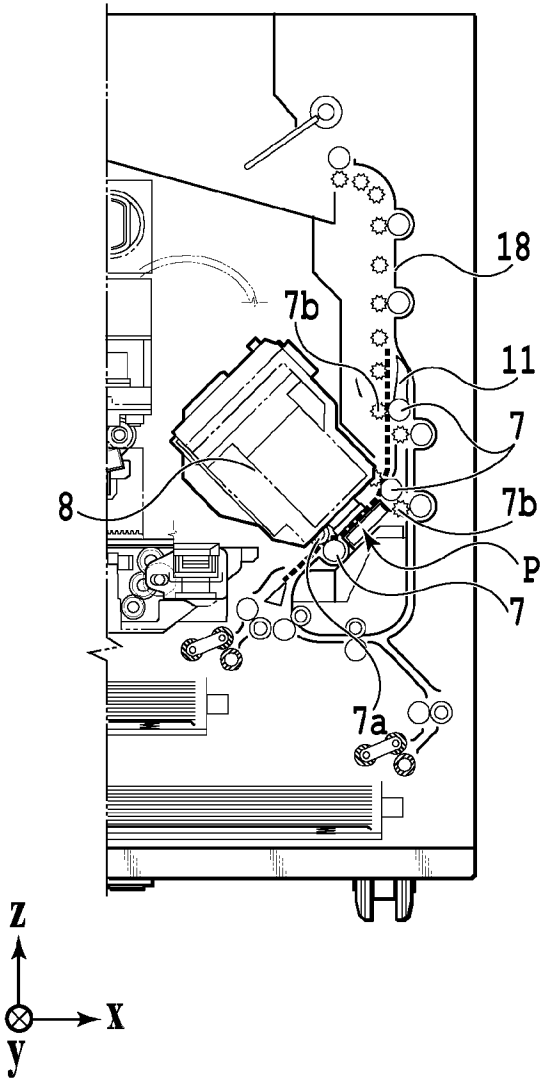
FIG. 4B is a conveyance route diagram of the print medium that is fed from the first cassette.
Figure 4A:
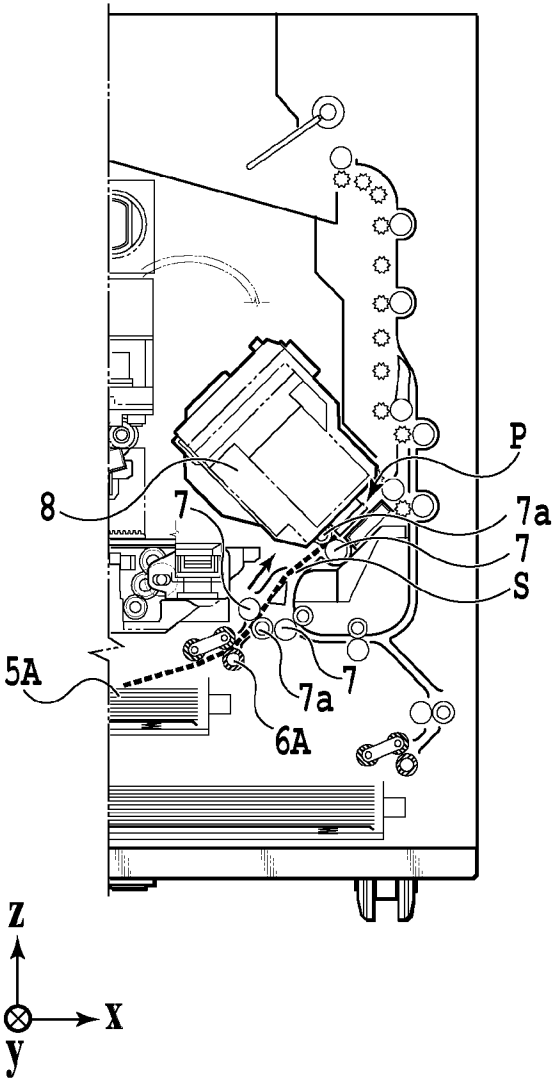
FIG. 4A is a conveyance route diagram of a print medium that is fed from a first cassette.

FIG. 4A to FIG. 4C are diagrams illustrating a conveyance route used when an A4-size print medium S contained in the first cassette 5A is fed. The print medium S loaded on a top in the first cassette 5A is separated from the other print media by the first feeding unit 6A, and conveyed toward a print area P between the platen 9 and the print head 8 while being nipped between conveyance rollers 7 and pinch rollers 7*a*. FIG. 4A illustrates a conveyance state taking place immediately before a leading end of the print medium S reaching the print area P. From being fed by the first feeding unit 6A until reaching the print area P, a traveling direction of the print medium S is changed from the horizontal direction (direction x) to a direction inclined by about 45 degrees with respect to the horizontal direction.

In the print area P, ink is ejected from the plurality of ejection ports included in the print head 8 toward the print medium S. The print medium S in an area where the ink is applied is supported on its rear side by the platen 9, and a distance between the ejection port surface 8*a* and the print medium S is kept constant. While being guided by conveyance rollers 7 and spur rollers 7*b*, the print medium S with the ink applied thereto passes on a left side of the flapper 11 of which a tip is inclined rightward, and is conveyed in a vertically upward direction of the printing apparatus 1 along the guide 18. FIG. 4B illustrates how the leading end of the print medium S passes the print area P and is conveyed in the vertically upward direction. At a position of the print area P inclined by about 45 degrees with respect to the horizontal direction, the traveling direction of the print medium S is changed to the vertically upward direction by conveyance rollers 7 and spur rollers 7*b*.

After being conveyed in the vertically upward direction, the print media S is discharged to the discharge tray 13 by the discharge roller 12 and spur rollers 7*b*. FIG. 4C illustrates how the leading end of the print medium S passes the discharge roller 12, and the print medium S is discharged to the discharge tray 13. The discharged print medium S is held on the discharge tray 13 with its surface on which an image is printed by the print head 8 facing downward.

Figure 5C:
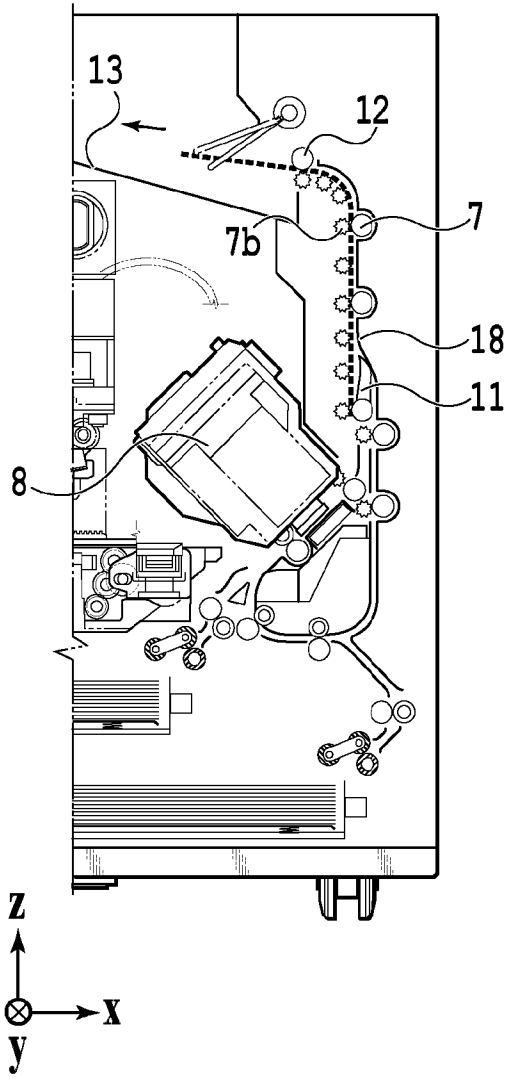
FIG. 5C is a conveyance route diagram of the print medium that is fed from the second cassette.
Figure 5B:
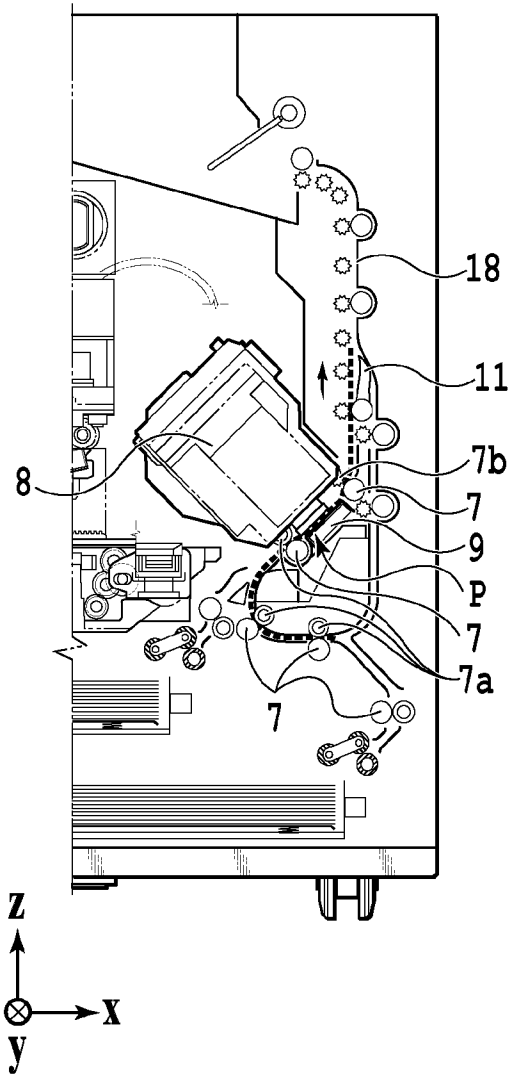
FIG. 5B is the conveyance route diagram of the print medium that is fed from a second cassette.
Figure 5A:
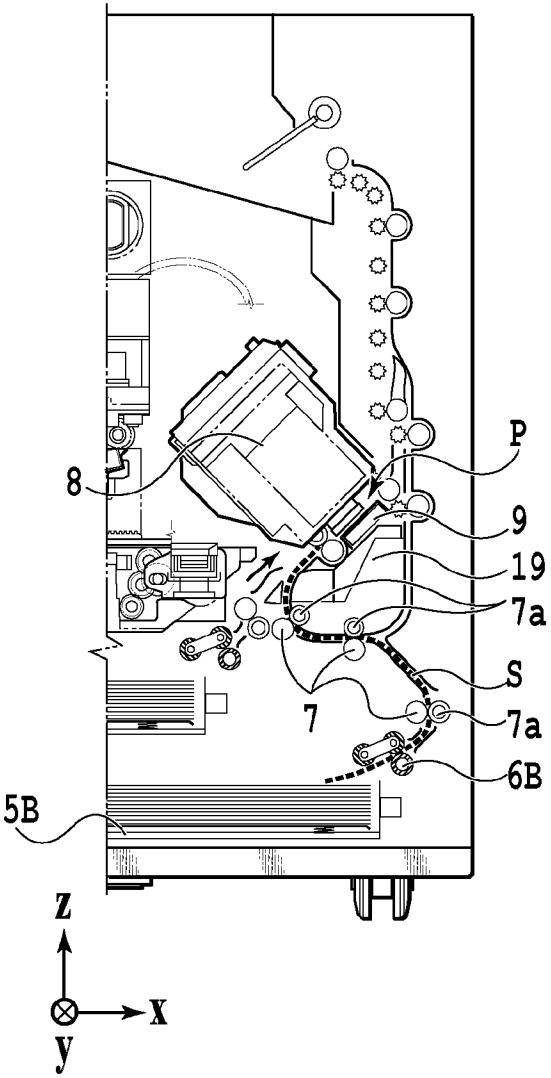
FIG. 5A is a conveyance route diagram of a print medium that is fed from a second cassette.

FIG. 5A to FIG. 5C are diagrams illustrating a conveyance route used when an A3-size print medium S contained in the second cassette 5B is fed. The print medium S loaded on a top in the second cassette 5B is separated from the other print media by the second feeding unit 6B, and conveyed toward the print area P between the platen 9 and the print head 8 while being nipped between conveyance rollers 7 and pinch rollers 7*a*.

FIG. 5A illustrates a conveyance state taking place immediately before a leading edge of the print medium S reaching the print area P. A conveyance route of the print medium S from being fed by second feeding unit 6B until reaching the print area P, a plurality of conveyance rollers 7, pinch rollers 7*a*, and the inner guide 19 are arranged, which convey the print medium S to the platen 9 while being curved in a shape of a letter S.

The rest of the conveyance route is the same as in the case of the A4-size print medium S illustrated in FIG. 4B and FIG. 4C. FIG. 5B illustrates how the leading end of the print medium S passes the print area P and is conveyed in the vertically upward direction. FIG. 5C illustrates how the leading end of the print medium S passes the discharge roller 12, and the print medium S is discharged to the discharge tray 13.

FIG. 6A to FIG. 6D illustrate a conveyance route of a case where print operation (double-sided printing) is performed on a back surface (second surface) of an A4-size print medium S. In a case where the double-sided printing is performed, the print operation is performed on a first surface (front surface) before performed on the second surface (back surface). A conveyance process for printing the first surface is the same as that illustrated in FIG. 4A to FIG. 4C, and thus the conveyance process will not be described. The conveyance process subsequent to FIG. 4C will be described below.

Figures 6A, 6B, 6C, 6D:
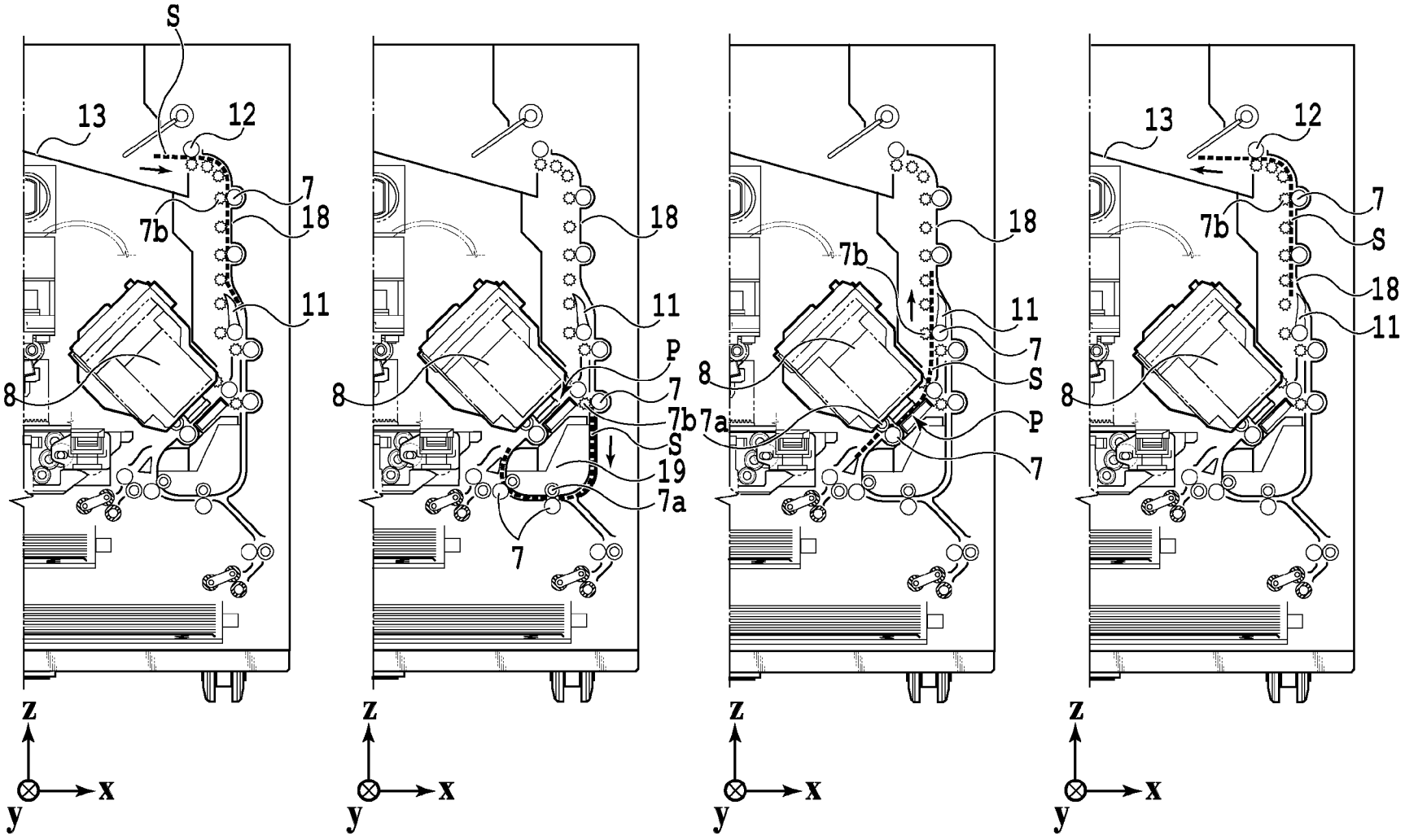
FIG. 6A is a conveyance route diagram of a case where print operation is performed on a back surface of a print medium.
FIG. 6B is a conveyance route diagram of the case where the print operation is performed on the back surface of the print medium.
FIG. 6C is a conveyance route diagram of the case where the print operation is performed on the back surface of the print medium.
FIG. 6D is a conveyance route diagram of the case where the print operation is performed on the back surface of the print medium.

When a trailing end of the print medium S passes the flapper 11 after completion of the print operation on the first surface by the print head 8, the print controller 202 causes conveyance rollers 7 to rotate backward to convey the print medium S toward an inside of the printing apparatus 1. At this time, the flapper 11 is controlled by an actuator (not illustrated) such that the tip of the flapper 11 is inclined leftward, and therefore a leading end of the print medium S (the trailing end in the print operation on the first surface) passes a right side of the flapper 11, and the print medium S is conveyed in a vertically downward direction. FIG. 6A illustrates how the leading end of the print medium S (the trailing end in the print operation on the first surface) passes the right side of the flapper 11.

Thereafter, the print medium S is conveyed along a curved circumference surface of the inner guide 19 to be conveyed to the print area P between the print head 8 and the platen 9 again. At this point, the second surface of the print medium S comes to face the ejection port surface 8*a* of the print head 8. FIG. 6B illustrates a conveyance state taking place immediately before a leading edge of the print medium S reaching the print area P for the print operation on the second surface.

The rest of the conveyance route is the same as in the case of the printing of the first surface illustrated in FIG. 4B and FIG. 4C. FIG. 6C illustrates how the leading end of the print medium S passes the print area P and is conveyed in the vertically upward direction. At this time, the flapper 11 is controlled by the actuator (not illustrated) to move to a position where the tip of the flapper 11 is inclined rightward. FIG. 6D illustrates how the leading end of the print medium S passes the discharge roller 12, and the print medium S is discharged to the discharge tray 13.

Next, the maintenance operation on the print head 8 will be described. As described with reference to FIG. 1, the maintenance unit 16 in the present embodiment includes the cap unit 10 and a wiping unit 17 and is configured to cause the cap unit 10 and the wiping unit 17 to work with the predetermined timing to perform the maintenance operation.

Figure 7:
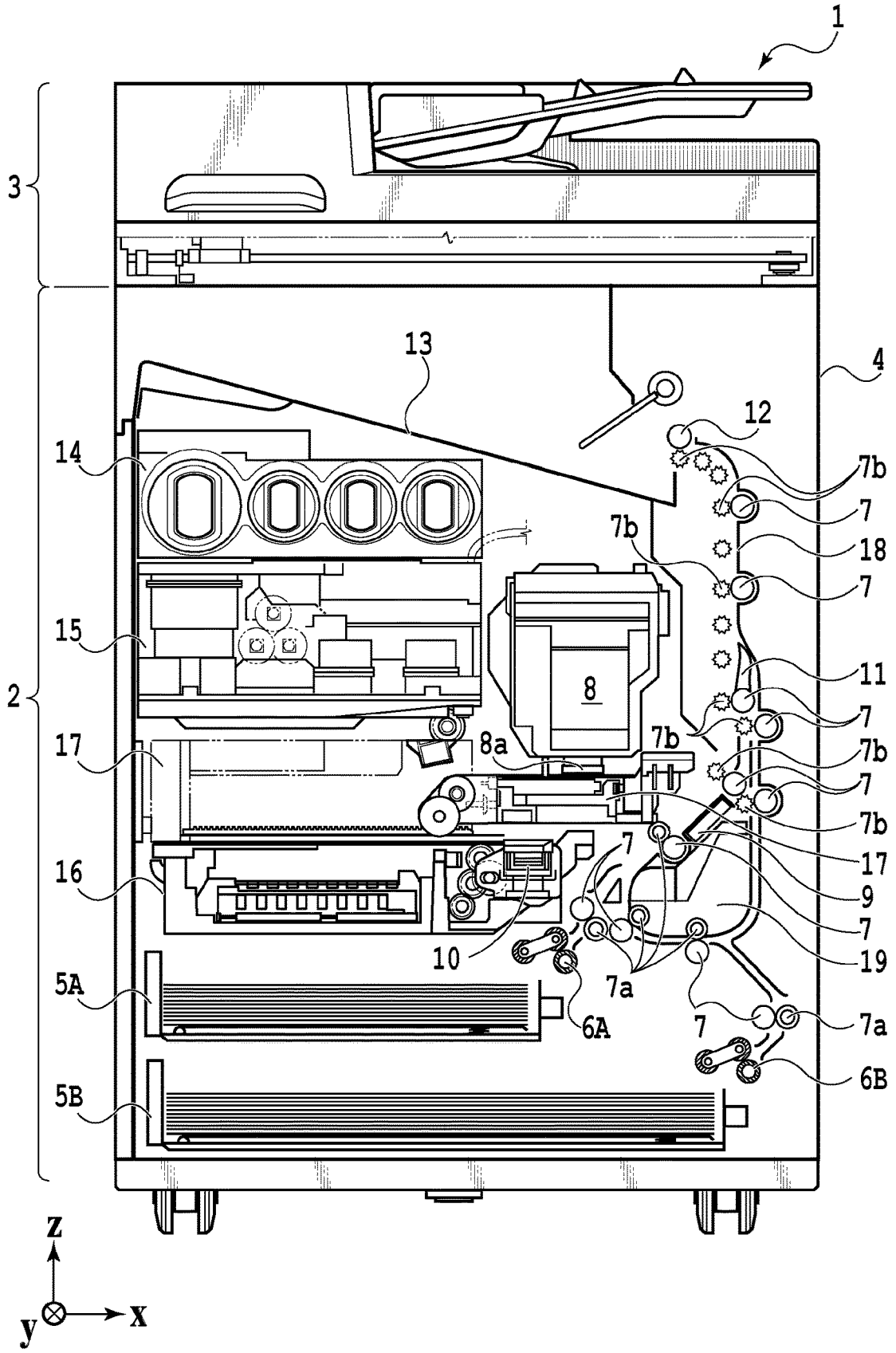
FIG. 7 is a diagram of the printing apparatus being in a maintenance state.

FIG. 7 is a diagram of the printing apparatus 1 being in the maintenance state. To move the print head 8 from the stand-by position illustrated in FIG. 1 to the maintenance position illustrated in FIG. 7, the print controller 202 moves the print head 8 upward in the vertical direction and at the same time moves the cap unit 10 downward in the vertical direction. The print controller 202 then moves the wiping unit 17 in a right direction in FIG. 7 from its inoperative position. The print controller 202 thereafter moves the print head 8 in the vertical direction downward to move the print head 8 to the maintenance position at which the maintenance operation is allowed.

In contrast, to move the print head 8 from the printing position illustrated in FIG. 3 to the maintenance position illustrated in FIG. 7, the print controller 202 causes the print head 8 to rotate by 45 degrees and move in the vertically upward direction simultaneously. The print controller 202 then moves the wiping unit 17 in the right direction from its inoperative position. The print controller 202 thereafter moves the print head 8 in the vertical direction downward to move the print head 8 to the maintenance position at which the maintenance operation by the maintenance unit 16 is allowed.

Figure 8A:
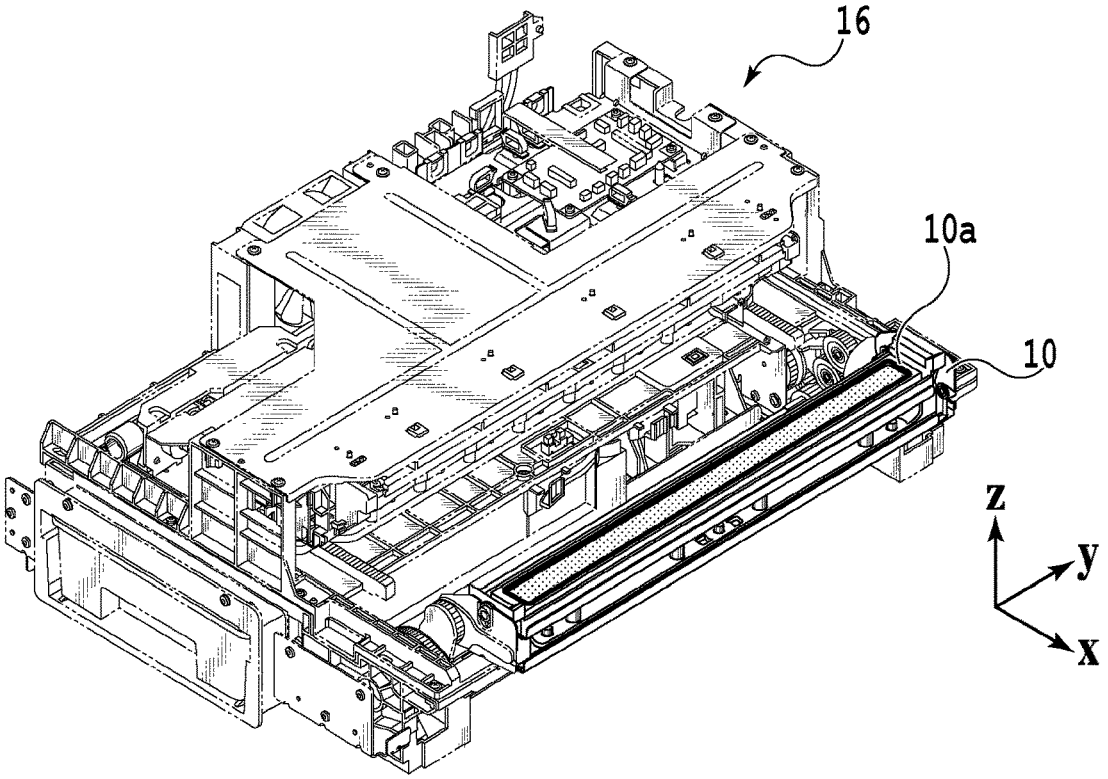
FIG. 8A is a perspective view illustrating a configuration of a maintenance unit.
Figure 8B:
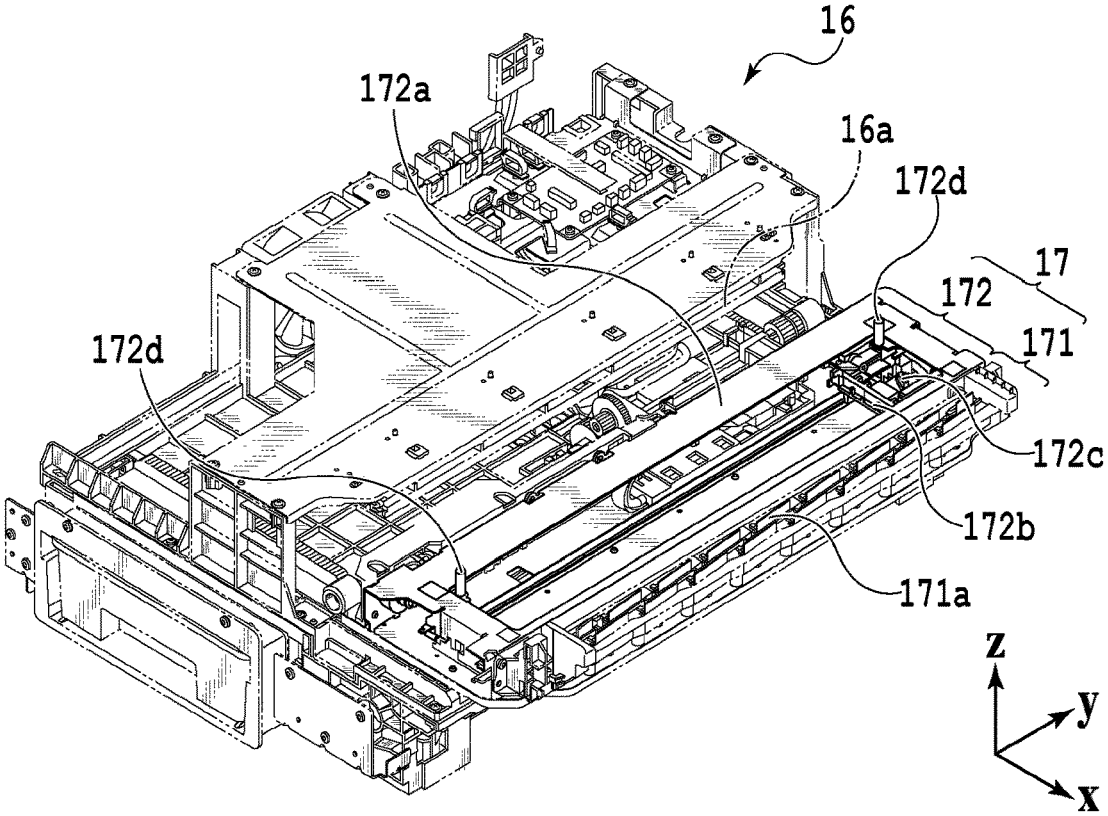
FIG. 8B is a perspective view illustrating a configuration of the maintenance unit.

FIG. 8A is a perspective view illustrating a state where the maintenance unit 16 is in its stand-by position, and FIG. 8B is a perspective view illustrating a state where the maintenance unit 16 is in a maintenance position. FIG. 8A corresponds to FIG. 1, and FIG. 8B corresponds to FIG. 7. When the print head 8 is in its stand-by position, the maintenance unit 16 is in its stand-by position illustrated in FIG. 8A, and the cap unit 10 has moved in the vertically upward direction, and the wiping unit 17 has been housed inside the maintenance unit 16. The cap unit 10 includes the box-shaped cap member 10*a* extending in the direction y. By bringing the cap member 10*a* into close contact with the ejection port surface 8*a* of the print head 8, the ejection port surface 8*a* can be covered, and the covering enables evaporation of ink from the ejection ports to be prevented or reduced. The cap unit 10 also has a function of causing cap member 10*a* to collect ink ejected in preliminary ejection or the like to allow a suction pump (not illustrated) to suck the collected ink.

In contrast, in the maintenance position illustrated in FIG. 8B, the cap unit 10 has moved in the vertically downward direction, and the wiping unit 17 is drawn from the maintenance unit 16. The wiping unit 17 includes two wiper units, or a blade wiper unit 171 and a vacuum wiper unit 172.

The blade wiper unit 171 includes a blade wiper 171*a* configured to wipe the ejection port surface 8*a* along the direction x and arranged in the direction y by a length corresponding to an array area of the ejection ports. In wiping operation using the blade wiper unit 171, the wiping unit 17 moves the blade wiper unit 171 in the direction x, with the print head 8 positioned at a height at which the print head 8 can abut against the blade wiper 171*a*. This movement causes the blade wiper 171*a* to wipe off ink and the like adhered to the ejection port surface 8*a*.

An entrance of the maintenance unit 16 for housing the blade wiper 171*a* is provided with a wet wiper cleaner 16*a* configured to remove ink adhered to the blade wiper 171*a* and apply wet fluid to the blade wiper 171*a*. Whenever the blade wiper 171*a* is housed by the maintenance unit 16, the wet wiper cleaner 16*a* removes sticking substances on the blade wiper 171*a* and applies the wet fluid to the blade wiper 171*a*. When the blade wiper 171*a* then wipes the ejection port surface 8*a*, the blade wiper 171*a* transfers the wet fluid to the ejection port surface 8*a*, which enhances a slip property between the ejection port surface 8*a* and the blade wiper 171*a*.

In contrast, the vacuum wiper unit 172 includes a flat plate 172*a* having an opening that extends in the direction y, a carriage 172*b* movable in the opening in the direction y, and a vacuum wiper 172*c* loaded on the carriage 172*b*. The vacuum wiper 172*c* is arranged such that the vacuum wiper 172*c* can wipe the ejection port surface 8*a* in the direction y with movement of the carriage 172*b*. At a tip of the vacuum wiper 172*c*, a suction port connected to a suction pump (not illustrated) is formed. Accordingly, by the movement of the carriage 172*b* in the direction y with the suction pump working, ink and the like adhered to the ejection port surface 8*a* of the print head 8 are pulled and sucked through the suction port by the vacuum wiper 172*c*. At this time, positioning pins 172*d* provided at both ends of the opening of the flat plate 172*a* are used for registration of the ejection port surface 8*a* with respect to the vacuum wiper 172*c*.

The present embodiment can perform first wiping processing, in which the wiping operation by the blade wiper unit 171 is performed, but the wiping operation by the vacuum wiper unit 172 is not performed, and second wiping processing, in which both of the wiping operations are performed in turn. To perform the first wiping processing, the print controller 202 first draws the wiping unit 17 from the maintenance unit 16, with the print head 8 retracted in the vertically upward direction from the maintenance position illustrated in FIG. 7. The print controller 202 then moves the print head 8 in the vertically downward direction to a position at which the print head 8 can abut against the blade wiper 171*a* and thereafter moves the wiping unit 17 into the maintenance unit 16. This movement causes the blade wiper 171*a* to wipe off ink and the like adhered to the ejection port surface 8*a*. That is, the blade wiper 171*a* wipes the ejection port surface 8*a* while moving into the maintenance unit 16 from the position to which the blade wiper 171*a* is drawn from the maintenance unit 16.

When the blade wiper unit 171 is housed, the print controller 202 then moves the cap unit 10 in the vertically upward direction to bring the cap member 10*a* into close contact with the ejection port surface 8*a* of the print head 8 (cover the ejection port surface 8*a* with the cap member 10*a*). In this state, the print controller 202 then drives the print head 8 to cause the print head 8 to perform the preliminary ejection and causes the suction pump to suck ink collected in the cap member 10*a*.

In contrast, to perform the second wiping processing, the print controller 202 first draws the wiping unit 17 slidingly from the maintenance unit 16, with the print head 8 retracted in the vertically upward direction from the maintenance position illustrated in FIG. 7. The print controller 202 then moves the print head 8 in the vertically downward direction to a position at which the print head 8 can abut against the blade wiper 171*a* and thereafter moves the wiping unit 17 into the maintenance unit 16. This causes the blade wiper 171*a* to perform its wiping operation on the ejection port surface 8*a*.

Next, the print controller 202 draws the wiping unit 17 slidingly from the maintenance unit 16 to a predetermined position, with the print head 8 retracted again in the vertically upward direction from the maintenance position illustrated in FIG. 7. Subsequently, descending the print head 8 to a wiping position illustrated in FIG. 7, the print controller 202 performs positioning between the ejection port surface 8*a* and the vacuum wiper unit 172 using the flat plate 172*a* and the positioning pins 172*d*. Thereafter, the print controller 202 executes the wiping operation by the vacuum wiper unit 172 described above. The print controller 202 retracts the print head 8 in the vertically upward direction, causes the wiping unit 17 to be housed, and thereafter performs the preliminary ejection into the cap member 10*a* by the cap unit 10 and suction operation on the collected ink, as in the first wiping processing.

Features of the present invention will be described below.

Figure 9:
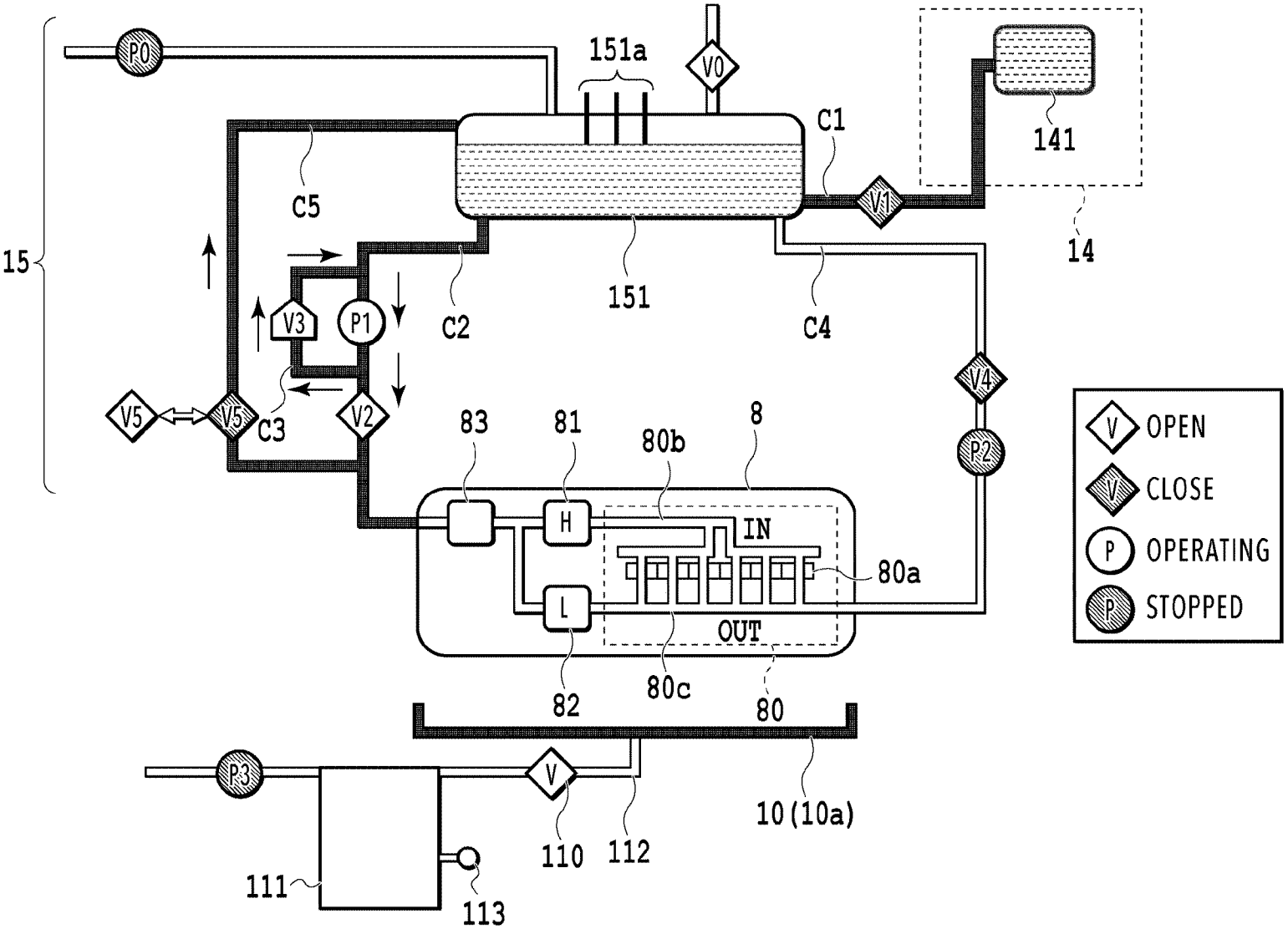
FIG. 9 is a diagram illustrating an ink supply system of the printing apparatus.

FIG. 9 is a diagram illustrating an ink supply unit 15 and the print head 8 of the printing apparatus 1. A channel configuration of an ink circulation system in the present embodiment will be described with reference to FIG. 9. The ink supply unit 15 is configured to supply ink from the ink reservoir unit 14 to the print head 8. The configuration described here is for one ink color, and such configuration is provided for each ink color.

The ink circulates mainly between the sub tank 151 and the print head 8. In the print head 8, ejection operation is performed on ink based on image data, and ink not ejected is collected to the sub tank 151.

A sub tank 151 containing a predetermined amount of ink is connected to a supply channel C2 for supplying the ink to the print head 8 and a collecting channel C4 for collecting the ink from the print head 8. That is, the sub tank 151, the supply channel C2, the print head 8, and the collecting channel C4 form a circulation path through which ink circulates.

The sub tank 151 is provided with a liquid surface detection unit 151*a* including a plurality of pins, and by detecting presence or absence of energization current between the pluralities of pins, the ink supply control portion 209 can grasp a height of an ink liquid surface, that is, a remaining ink amount in the sub tank 151. A pressure reduction pump P0 is a negative pressure generation source configured to depressurize an inside of the sub tank 151. An air release valve V0 is a valve configured to switch whether to communicate the inside of the sub tank 151 with an atmosphere. A main tank 141 is a tank configured to contain ink to be supplied to the sub tank 151. The main tank 141 is made up of a flexibility member and configured to vary an inner volume of the flexibility member to fill the sub tank 151 with ink. The main tank 141 is configured to be detachable (replaceable) with respect to a body of the printing apparatus. The sub tank 151 and the main tank 141 are connected by an inter-tank connection channel C1, in a middle of which a tank supply valve V1 configured to switch connection between the sub tank 151 and the main tank 141 is arranged.

In the configuration described above, when the ink supply control portion detects with the liquid surface detection unit 151*a* that the ink in the sub tank 151 has become smaller than a predetermined amount, the ink supply control portion closes the air release valve V0, a supply valve V2, a collection valve V4, and a head replacement valve V5 and opens the tank supply valve V1. In this state, the ink supply control portion 209 operates the pressure reduction pump P0. This places the inside of the sub tank 151 under a negative pressure, which causes ink to be supplied from the main tank 141 to the sub tank 151. When the ink supply control portion 209 with the liquid surface detection unit 151*a* that the ink in the sub tank 151 has become larger than the predetermined amount, the ink supply control portion 209 closes the tank supply valve V1 and stops the pressure reduction pump P0.

A supply channel C2 is a channel for supply of ink from the sub tank 151 to the print head 8, and in a middle of the supply channel C2, a supply pump P1 and the supply valve V2 are arranged. In the print operation, driving the supply pump P1 with the supply valve V2 opened can circulate ink through the circulation path while supplying the ink to the print head 8. An amount of ink ejected per unit time by the print head 8 varies according to image data. A flow rate of the supply pump P1 is determined such that the supply pump P1 can deal with ejection operation of the print head 8 with a maximum consumption of ink per unit time.

A relief channel C3 is a channel provided on an upstream side of the supply valve V2 and configured to connect between upstream and downstream sides of the supply pump P1. Let a first connecting portion refer to a connecting portion of the relief flow path C3 connected to the upstream side of the supply pump P1, and a second connecting portion refer to a connecting portion of the relief flow path C3 connected to the downstream side of the supply pump P1. In a middle of the relief channel C3, a relief valve V3, which is a differential pressure regulating valve, is arranged. In a case where an amount of ink supply per unit time from the supply pump P1 is larger than a total value of an amount of ejection per unit time by the print head 8 and a flow amount per unit time of a collection pump P2 (an amount of ink drawn up), the relief valve V3 is opened according to a pressure acting on itself. This forms a cyclic channel made up of a part of the supply channel C2 and the relief channel C3. By providing the configuration including the relief channel C3 described above, an amount of ink supply to the print head 8 is adjusted according to the consumption of ink in the print head 8, which enables a fluid pressure of an inside of the circulation path to be kept stable whatever the image data is.

The collecting channel C4 is a channel for collection of ink from the print head 8 to the sub tank 151, and in a middle of the collection channel C4, the collection pump P2 and the collection valve V4 are arranged. To circulate ink through the circulation path, the collection pump P2 serves as a negative pressure generation source to suck ink from the print head 8. Driving the collection pump P2 causes an appropriate pressure difference between an IN channel 80*b* and an OUT channel 80*c* in the print head 8, which enables ink to be circulated between the IN channel 80*b* and the OUT channel 80*c*. A channel configuration of the print head 8 will be described below in detail.

The collection valve V4 is a valve configured to prevent backflow of ink in not performing the print operation, that is, when the ink is not circulated in the circulation path. In the circulation path in the present embodiment, the sub tank 151 is disposed above the print head 8 in the vertical direction (see FIG. 1). Therefore, when the supply pump P1 and the collection pump P2 are not driven, there is a risk that backflow of ink occurs from the sub tank 151 to the print head 8 due to a water head difference between the sub tank 151 and the print head 8. In the present embodiment, the collection valve V4 is provided in the collection channel C4 to prevent such backflow.

Similarly, the supply valve V2 functions as a valve configured to prevent supply of ink from the sub tank 151 to the print head 8 in not performing the print operation, that is, when the ink is not circulated in the circulation path.

A head replacement channel C5 is a channel connecting the supply channel C2 and an air chamber of the sub tank 151 (a space not containing ink), and in a middle of the head replacement channel C5, the head replacement valve V5 is arranged. One end of the head replacement channel C5 is connected to an upstream of the print head 8 in the supply channel C2 and referred to as a third connecting portion. The third connecting portion is arranged on a downstream side of the supply valve V2. Another end of the head replacement channel C5 is connected to an upper portion of the sub tank 151, communicates with the air chamber inside the sub tank 151, and is referred to as a fourth connecting portion. The head replacement channel C5 is used to collect ink from the print head 8 in use, such as replacing the print head 8 or transporting the printing apparatus 1. The head replacement valve V5 is controlled by the ink supply control portion 209 in such a manner as to be closed except filling the printing apparatus 1 with ink and collecting ink from the print head 8. In addition, the supply valve V2 mentioned above is provided in the supply channel C2 between the third connecting portion to the head replacement channel C5 and the second connecting portion to the relief channel C3. The second connecting portion may be arranged in the supply channel C2 downstream of the third connecting portion.

Next, the channel configuration of the print head 8 will be described. Ink supplied to the print head 8 through the supply channel C2 passes through a filter 83 and is thereafter supplied to a first negative pressure control unit 81 and a second negative pressure control unit 82. The first negative pressure control unit 81 has a control pressure set at a low negative pressure. The second negative pressure control unit 82 has a control pressure set at a high negative pressure. These pressures of the first negative pressure control unit 81 and the second negative pressure control unit 82 are generated within a proper range by driving the collection pump P2.

An ink ejection portion 80 includes a plurality of print element substrates 80*a* in which the plurality of ejection ports are arranged, respectively, forming a long ejection port array. A common supply channel 80*b* (IN channel) for guiding ink supplied from the first negative pressure control unit 81 and a common collection channel 80*c* (OUT channel) for guiding ink supplied from the second negative pressure control unit 82 also extend in a direction of arranging the print element substrates 80*a*. In addition, in each of the print element substrates 80*a*, an individual supply channel connected to the common supply channel 80*b* and an individual collection channel connected to the common collection channel 80*c* are formed.

Therefore, in each print element substrate 80*a*, a flow of ink that flows in from common supply channel 80*b* having a relatively low negative pressure and flows out to common collection channel 80*c* having a relatively high negative pressure. On a path between the individual supply channel and the individual collection channel, a pressure chamber communicating with each ejection port and configured to be filled with ink is provided, and the flow of ink is also formed in the ejection port and the pressure chamber not in printing. When the print element substrate 80*a* performs the ejection operation, part of ink moving from the common supply channel 80*b* to the common collection channel 80*c* is ejected from an ejection port to be consumed, but ink not ejected moves to the collection channel C4 via the common collection channel 80*c*.

In the configuration described above, when the print operation is performed, the ink supply control portion closes the tank supply valve V1 and the head replacement valve V5, opens the air release valve V0, the supply valve V2, and the collection valve V4, and drives the supply pump P1 and the collection pump P2. This establishes the circulation path: the sub tank 151→the supply path C2→the print head 8→the collection channel C4→the sub tank 151. In a case where the amount of ink supply per unit time from the supply pump P1 is larger than the total value of the amount of ejection per unit time by the print head 8 and the flow amount per unit time of the collection pump P2, ink flows into the relief channel C3 from the supply channel C2. The flow rate of ink flowing into the print head 8 from the supply channel C2 is thereby adjusted.

Not in the print operation, the ink supply control portion stops the supply pump P1 and the collection pump P2, and closes the air release valve V0, the supply valve V2, and the collection valve V4. This stops the flow of the ink in the print head 8, and the backflow due to the water head difference between the sub tank 151 and the print head 8 is also restrained. In addition, by closing the air release valve V0, leakage and evaporation of the ink from the sub tank 151 are restrained.

To collect the ink from the print head 8, the ink supply control portion closes the tank supply valve V1, the supply valve V2, and the collection valve V4, opens the air release valve V0 and the head replacement valve V5, and drives the pressure reduction pump P0. This brings the inside of the sub tank 151 into a negative pressure state, which causes the ink inside the print head 8 is collected to the sub tank 151 via the head replacement channel C5. As seen from the above, the head replacement valve V5 is a valve that is closed in the normal print operation and during standby and opened to collect ink from the print head 8. Note that the head replacement valve V5 is also opened to fill the head replacement channel C5 with ink in filling the print head 8 with the ink.

The cap member 10*a* is connected to a channel valve 110, a buffer tank 111 with a predetermined capacity, and a channel pump P3 through a channel 112. The cap member 10*a* can be placed under a negative pressure by opening the channel valve 110 and driving the channel pump P3. In addition, a pressure sensor (pressure detection means) 113 capable of detecting pressure is provided in an inside of the buffer tank 111. The pressure sensor 113 can detect (is configured to acquire) pressure of (a connection space between) the inside of the buffer tank 111 and an inside of the channel (112, etc.) on an upstream side of the channel pump P3. The detected pressure is acquired by the print controller (pressure acquisition means) 202. A position for providing the pressure sensor 113 is not limited to the inside of the buffer tank 111 and any position between the channel pump P3 and the print head 8 is allowed.

How to fill the print head 8 with ink in the present embodiment will be described. In the present embodiment, the first filling operation, normal filling operation, and second filling operation can be executed. In the first filling operation, filling operation is performed with the channel valve 110 opened, and in the second filling operation, depressurizing processing is performed with the channel valve 110 closed, and thereafter the channel valve 110 is opened to perform the filling operation. In the present embodiment, the print head 8 is filled normally by the first filling operation. However, even if the first filling operation is performed, the buffer tank 111 or the channel may not reach a predetermined negative pressure within a predetermined time period. In that case, a second filling operation is performed in which it is assumed that leakage occurs between the ejection port surface 8*a* of the recording head 8 and the cap member 10*a*.

The first filling operation is filling operation in which the channel pump P3 is driven to place an inside of the print head 8 under a negative pressure, so that the print head 8 is filled with ink from the sub tank 151. In contrast, the second filling operation is filling operation in which the channel pump P3 is driven with the channel valve 110 being closed to build up a negative pressure inside the buffer tank 111, so as to establish a high negative-pressure state, and when the pressure sensor 113 then detects that the inside of the buffer tank 111 has reached a predetermined negative pressure, the channel valve 110 is opened to strong negative pressure to the print head 8, so that the print head 8 is filled with ink from the sub tank 151. Even in a case where a leakage occurs between the ejection port surface 8*a* and the cap member 10*a*, this second filling operation dissolves the leakage by the strong negative pressure, which enables the filling to be performed efficiently.

Figure 10:
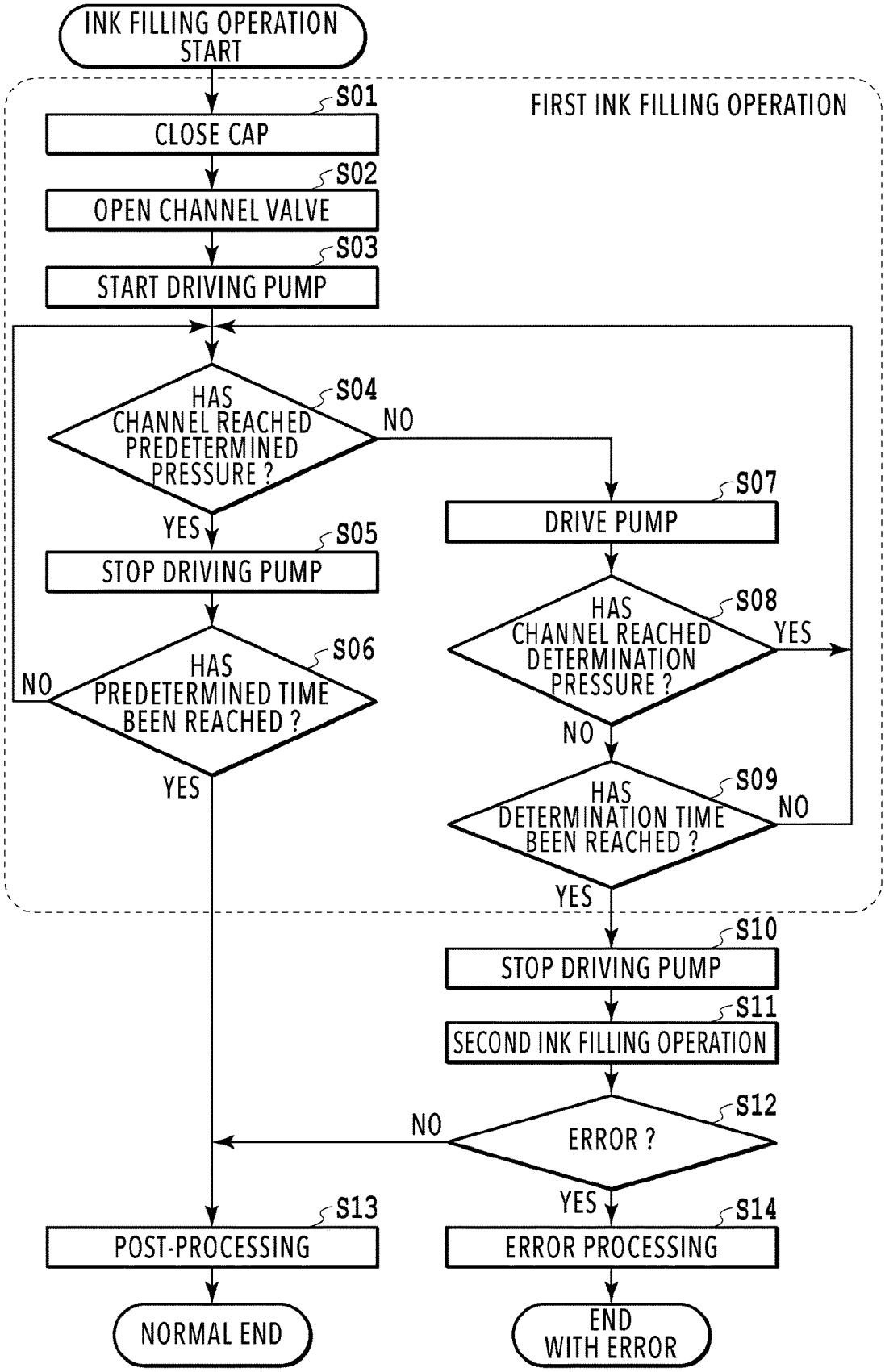
FIG. 10 is a flowchart illustrating processing in ink filling operation.

FIG. 10 is a flowchart illustrating processing in the ink filling operation in the present embodiment. The ink filling operation is executed by the print controller 202 using the ink supply control portion 209. The ink filling operation in the present embodiment will be described below with reference to the flowchart.

Upon start of the ink filling operation, in S01, the ejection port surface 8*a* of the print head 8 is caused to abut against the cap unit 10 to form an enclosed space between the ejection port surface 8*a* and the cap unit 10. Thereafter, in S02, in a case where the channel valve 110 is closed, the channel valve 110 is opened to bring the channel 112 into an open state. Then, in S03, the channel pump P3 is driven. Driving the channel pump P3 places the insides of the cap unit 10, the print head 8, and the channel 112 under a negative pressure. Thereafter, in S04, the pressure sensor 113 determines whether the pressure of the inside of the channel has reached a predetermined pressure.

Figure 11:
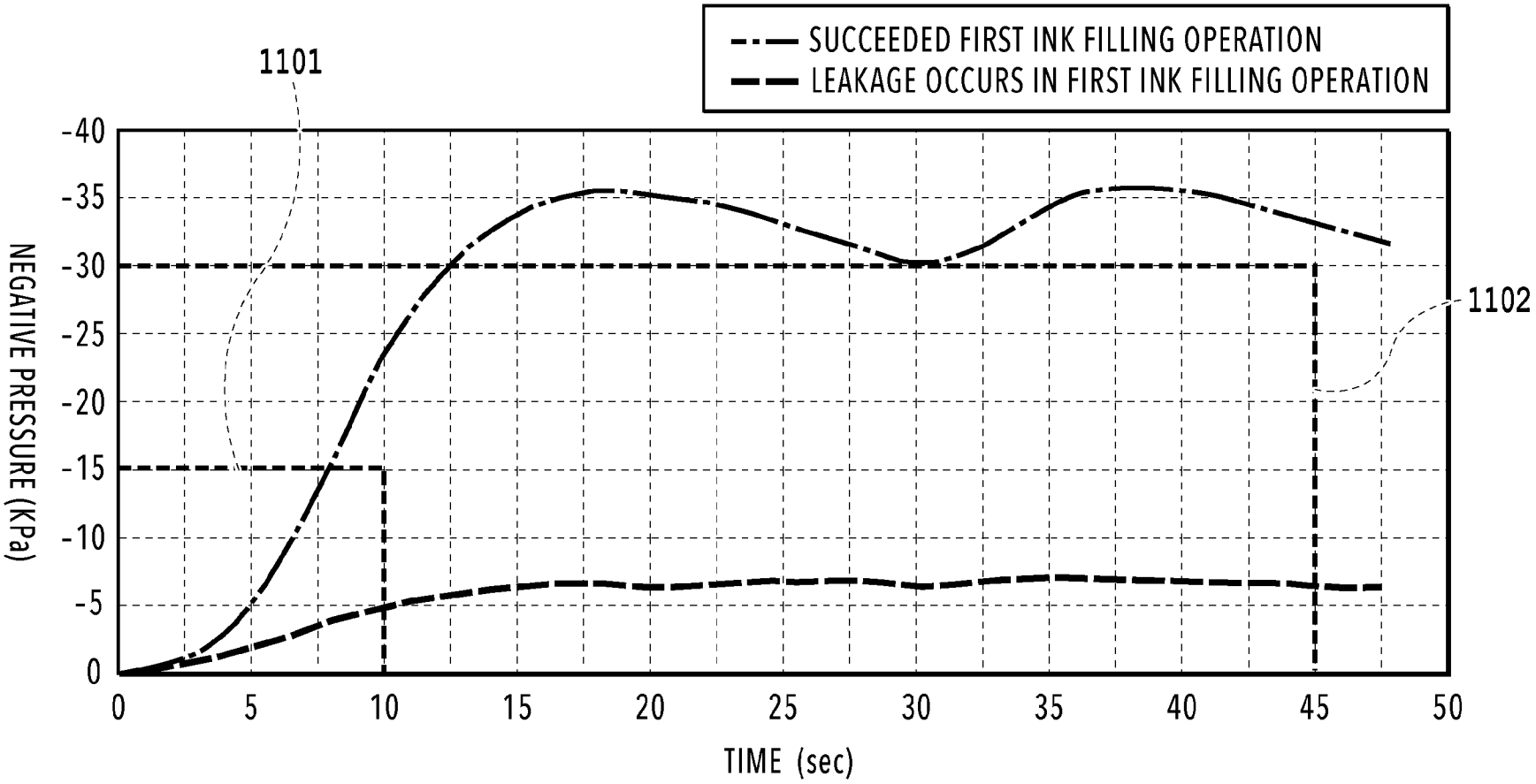
FIG. 11 is a graph illustrating a negative pressure profile of an inside of a channel of a time when a channel pump is driven.

Here, FIG. 11 is a graph illustrating a negative pressure profile of the inside of the channel (the same as the inside of the buffer tank) of a time when the channel pump P3 is driven. In a case where no leakage occurs between the ejection port surface 8*a* of the print head 8 and the cap member 10*a*, the negative pressure of the inside of the channel is reached to the first predetermined pressure (for example, −30 KPa to −35 KPa) within a predetermined time T (for example, 45 seconds) for driving the channel pump P3 as shown by a dash-dot line in the graph. However, in a case where a leakage occurs between the ejection port surface 8*a* and the cap member 10*a*, the negative pressure of the inside of the channel does not reach the first predetermined pressure, as illustrated by a dotted line in the graph even if the channel pump P3 is driven for a predetermined time T.

Returning to the flowchart of FIG. 10, the ink filling operation in the case where no leakage occurs between the ejection port surface 8*a* of the print head 8 and the cap member 10*a* will be described. In S04, whether the pressure of the inside of the channel has reached the first predetermined pressure (−30 KPa to −35 KPa in the present embodiment) is determined. Since the negative pressure resists increasing immediately after the start of the filling operation, if the first predetermined pressure has not been reached, the processing proceeds to S07 to continue the drive of the channel pump P3, and in S08, whether the pressure of the inside of the channel has reached a determination pressure (e.g., −15 KPa) is determined. If the pressure has not reached the determination pressure, whether a determination time T2 (e.g., 10 seconds) has been reached is determined after driving the channel pump P3 in S09. If the pressure in the channel reaches the determination pressure in S08, the processing returns to S04.

If it is determined in S04 that the pressure of the inside of the channel has reached the first predetermined pressure, the drive of the channel pump P3 is stopped in S05, and in S06, whether the predetermined time T1 (45 seconds in the present embodiment) has elapsed is determined. Unless the predetermined time T1 has elapsed, the processing returns to S04.

Even if the pressure in the channel reaches the first predetermined pressure, the negative pressure in the channel becomes decrease when the ink is filled in the channel by continuing the filling operation. Therefore, the process returns to S04 until the predetermined time T1 required for completing the filling of the channel has elapsed. In a case where the continue of the filling operation leads to the determination that the pressure is equal to or lower than the first predetermined pressure in S04, the processing proceeds to S07 to drive the channel pump P3 again.

Therefore, by repeating a flow from S04 to S08, the filling operation is continued while the inside of the channel is kept at the first predetermined pressure. When the predetermined time T1 thereafter elapses, the processing proceeds to post-processing of S13 described below.

Next, the ink filling operation in the case where a leakage occurs between the ejection port surface 8*a* of the print head 8 and the cap member 10*a* will be described. If it is determined in S04 that the pressure of the inside of the channel has not reached the first predetermined pressure (−30 KPa to −35 KPa), the processing proceeds to S07 to continue the drive of the channel pump P3. In S08, it is determined whether the pressure in the channel has reached a determination pressure (for example, −15 KPa). If the pressure has not reached the determination pressure, whether the determination time T2 (e.g., 10 seconds) has been reached is determined in S09. Unless the determination time T2 has elapsed, the processing returns to S04 and S07 to continue the drive of the channel pump P3. If it is determined in S09 that the determination time T2 has elapsed, the processing proceeds to S10. Processes from S02 to S06 or S09 described above are referred to as the first filling operation.

As seen from the above, the present embodiment first determines whether the pressure has reached the predetermined pressure, and if the pressure has not reached the predetermined pressure, whether the determination pressure has been reached is further checked. If the determination time T2 has passed without reaching the determination pressure, it is determined that a leakage occurs between the ejection port surface 8*a* and the cap member 10*a*, and the second filling operation is started.

If it is determined in S09 that the determination time T2 has elapsed, the drive of the channel pump P3 is stopped in S10, and in S11, the second ink filling operation described below is performed. After the second filling operation, whether any error has occurred in the filling operation is determined in S12. If it is determined that an error such as failure to filling the print head 8 as occurred, the processing proceeds to S14 to perform error processing and is then ended (end with error). If it is determined in S12 that no error has occurred, the processing proceeds to S13 to perform post-processing. Here, the post-processing is maintenance operation such as idle suction of surplus ink that spills from an ejection port during the filling to be retained in the cap member 10*a*, wiping off the ejection port surface 8*a*, and the preliminary ejection. After the end of the post-processing, the processing of the filling operation is ended.

Figure 12:
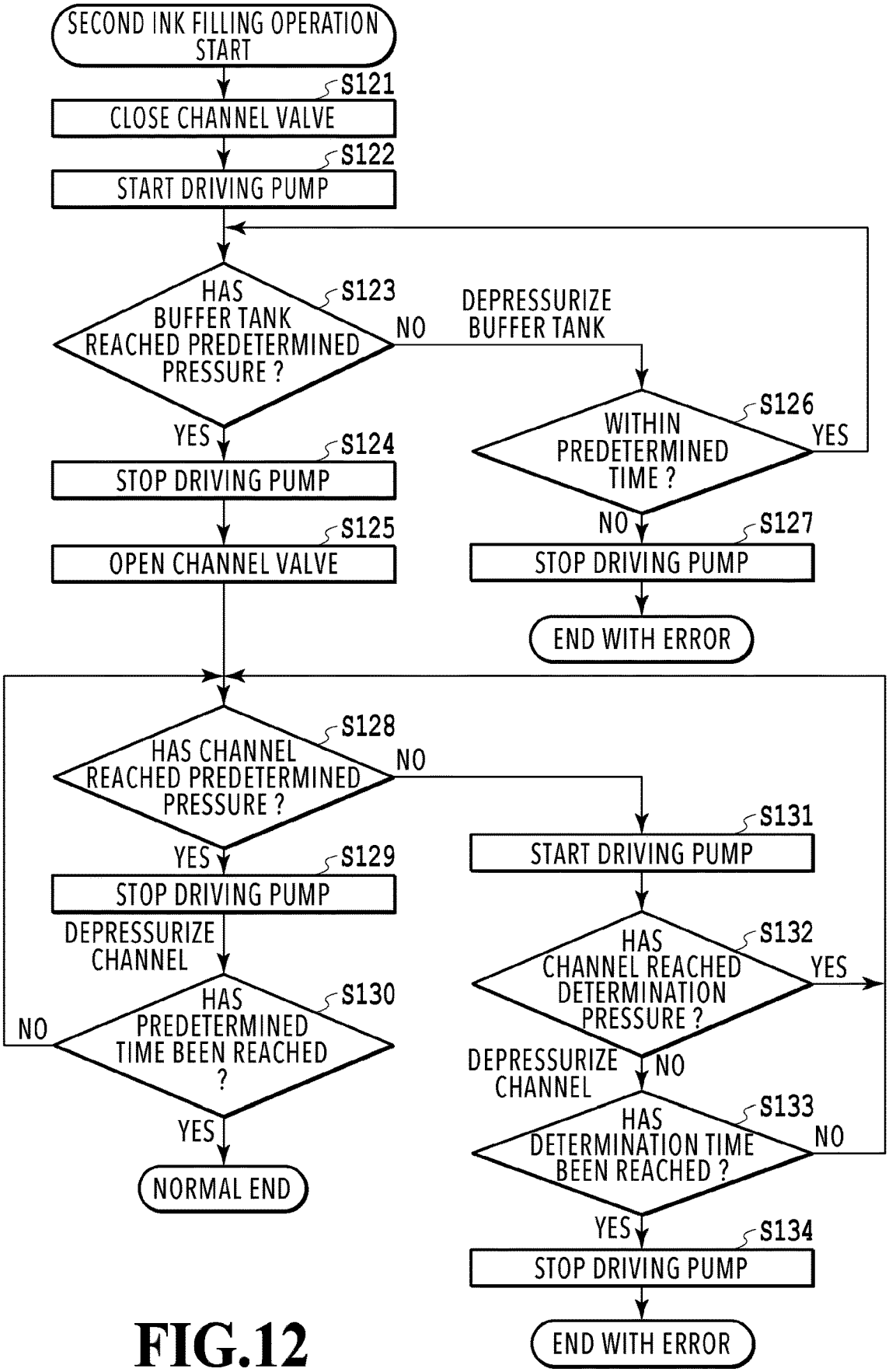
FIG. 12 is a flowchart illustrating processing in second filling operation.

FIG. 12 is a flowchart illustrating processing in the second filling operation. The ink filling operation is executed by the print controller 202 using the ink supply control portion 209. The second filling operation will be described below with reference to the flowchart.

Upon start of the second filling operation, the channel valve 110 is closed in S121, and in S122, drive of the channel pump P3 is started. Thereafter, whether the inside of the buffer tank 111 has reached a second predetermined pressure (e.g., −78 KPa) is determined in S123. If it is determined that the predetermined pressure has been reached, the drive of the channel pump P3 is stopped in S124, and in S125, the channel valve 110 is opened. If it is determined in S123 that the second predetermined pressure has not been reached, the processing proceeds to S126 to determine whether a predetermined time T3 has elapsed. If the predetermined time T3 has not elapsed, the processing returns to S123 to repeat the processing. If the predetermined time T3 has elapsed, the drive of the channel pump P3 is stopped in S127, and the processing is ended (end with error).

Figure 13:
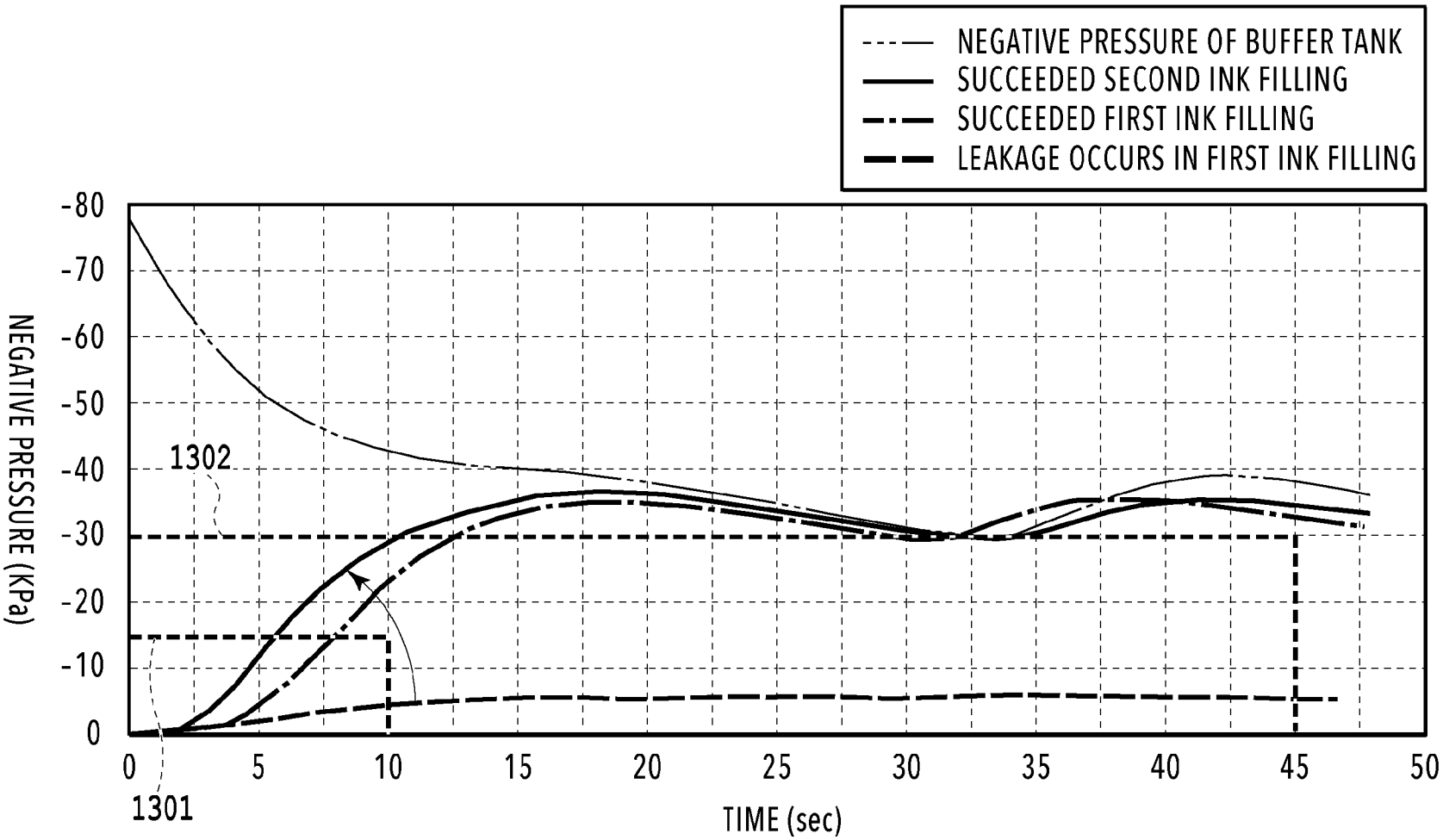
FIG. 13 is a graph illustrating negative pressure profiles of an inside of a buffer tank and an inside of a channel.

Here, FIG. 13 is a graph illustrating negative pressure profiles of the insides of the buffer tank 111 and the channel after the channel valve 110 is opened in S125 in the second filling operation. When the channel valve 110 is opened, the negative pressure of the inside of the buffer tank 111 rapidly weakens, and conversely, the negative pressure the inside of the channel, on which the negative pressure from the buffer tank 111 acts, rapidly increases. In a case of the first filling operation, where the inside of the channel is depressurized, the negative pressure gradually increases, but in the second filling operation, the inside of the channel is rapidly depressurized by releasing the high negative pressure that is built up in a closed space inside the channel blocked by the channel valve 110.

By depressurizing the inside of the channel rapidly in this manner, even in a case where a leakage occurs between the ejection port surface 8*a* and the cap member 10*a*, the rapid generation of the negative pressure inside the cap member 10*a* increases a flow rate and a flow velocity of air flowing in through a gap in a location of the leakage. This produces a flow resistance in the gap, increasing the negative pressure of the inside of the cap member 10*a*, which causes the location of the leakage in the cap member 10*a* is attached to the ejection port surface 8*a*. The leakage occurring between the ejection port surface 8*a* and the cap member 10*a* is dissolved in this manner. After the determination time has elapsed, the substantially same negative pressure as one obtained by the first filling operation, in which no leakage occurs, can be obtained.

Returning here to the flowchart of FIG. 12, after the channel valve 110 is opened in S125, whether the pressure of the inside of the channel has reached a predetermined pressure is determined in S128. The subsequent processing up to S134 is the same as the processing from S04 to S10 in the first filling operation (see FIG. 10) and will not be described.

In the present embodiment, an example in which the present invention is applied to operation to fill the print head 8 with ink from the sub tank 151 is described, but the example is not limitative. That is, the present invention is applicable to any configuration that includes operation that depressurizes the inside of the print head 8 by sucking the ejection port surface 8*a* and the cap member 10*a* with the ejection port surface 8*a* and the cap member 10*a* abutting each other.

As seen from the above, if the predetermined negative pressure (determination pressure) is not reached within the predetermined time (determination time T2) by the normal filling operation (first filling operation), it is assumed that a leakage occurs in the cap member 10*a*, and the second filling operation is performed. This enables provision of an inkjet printing apparatus and an ink filling method capable of performing the ink filling efficiently.

Second Embodiment

A second embodiment of the present invention will be described below with reference to the drawings. A basic configuration in the present embodiment is the same as that in the first embodiment, and thus only features of the present embodiment will be described below.

A printing apparatus in the present embodiment has a configuration including a sub tank 90 provided with a second supply valve 114 and is a printing apparatus of so-called a "serial head system", in which a print medium is conveyed by a conveyance mechanism, and a print head is operated in a direction perpendicular to a direction of the movement of the print medium to perform printing, and to which the present invention is applied. In a case of a configuration in which the sub tank 90 is provided with the second supply valve 114, the first filling operation differs from that in the first embodiment.

Figure 14:
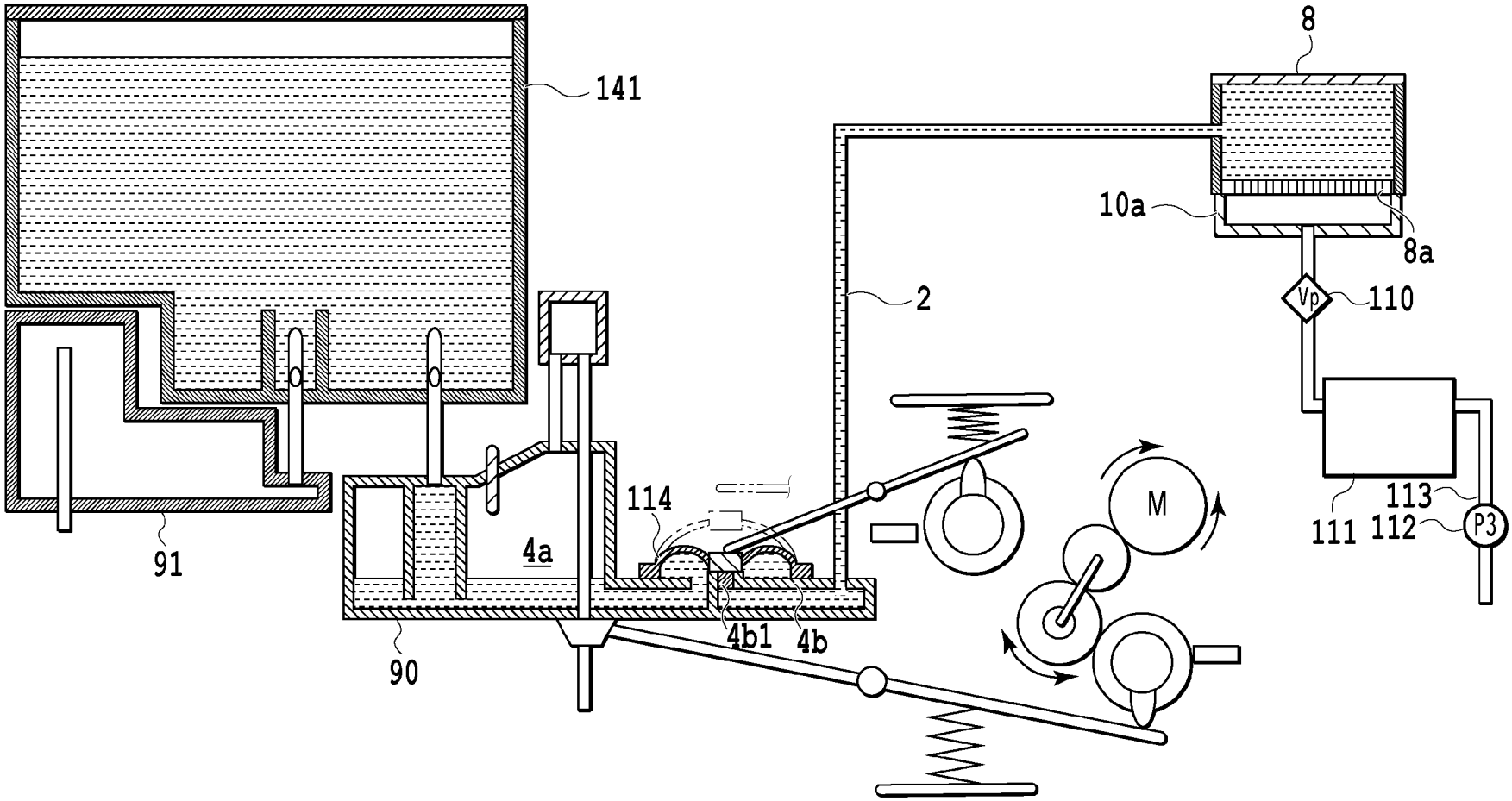
FIG. 14 is a diagram illustrating the printing apparatus.

FIG. 14 is a diagram illustrating the printing apparatus in the present embodiment. A main tank 141 is connected to an air communication chamber 91 and the sub tank 90. On part of a wall forming the sub tank 90, the second supply valve 114, which is capable of varying an inner volume of the sub tank 90, is provided. In the present embodiment, the sub tank 90 includes a liquid chamber portion 4*a* and a channel portion 4*b* communicating with the liquid chamber portion 4*a*, and the second supply valve 114 is provided in the channel portion 4*b*. The second supply valve 114 is formed of a diaphragm being a rubber having flexibility.

As seen from the above, the second supply valve 114 in the present embodiment is provided in the sub tank 90, enabling the sub tank 90 to be varied in its inner volume. In the present embodiment, the second supply valve 114 is formed as a part of the sub tank 90, and the second supply valve 114 is made swelling outward from a wall of the channel portion 4*b*, which brings about a state where the inner volume of the sub tank 90 is expanded.

In contrast, in a case where a center portion of the second supply valve 114 is pressed to come in contact with the wall of the channel portion 4*b* as illustrated in FIG. 14, the inner volume of the sub tank 90 is reduced as compared with the aforestated expanded state. The channel portion 4*b* in the embodiment is provided with a communicating opening 4*b*1 configured to be opened and closed by the second supply valve 114 and is coupled to a bottom portion of a supply tube 2 on a downstream side of the communicating opening 4*b*1 (a downstream side in a flow direction of ink from the sub tank 90 to the print head 8). Therefore, in a state where the second supply valve 114 is pressed, the communicating opening 4*b*1 is blocked by the second supply valve 114, and the communication between the liquid chamber portion 4*a* and the print head 8 is shut off. That is, the second supply valve 114 is configured to also function as an on-off valve that allows the print head 8 to communicate with the liquid chamber portion 4*a* and shuts off between the print head 8 and the liquid chamber portion 4*a*.

Figure 15:
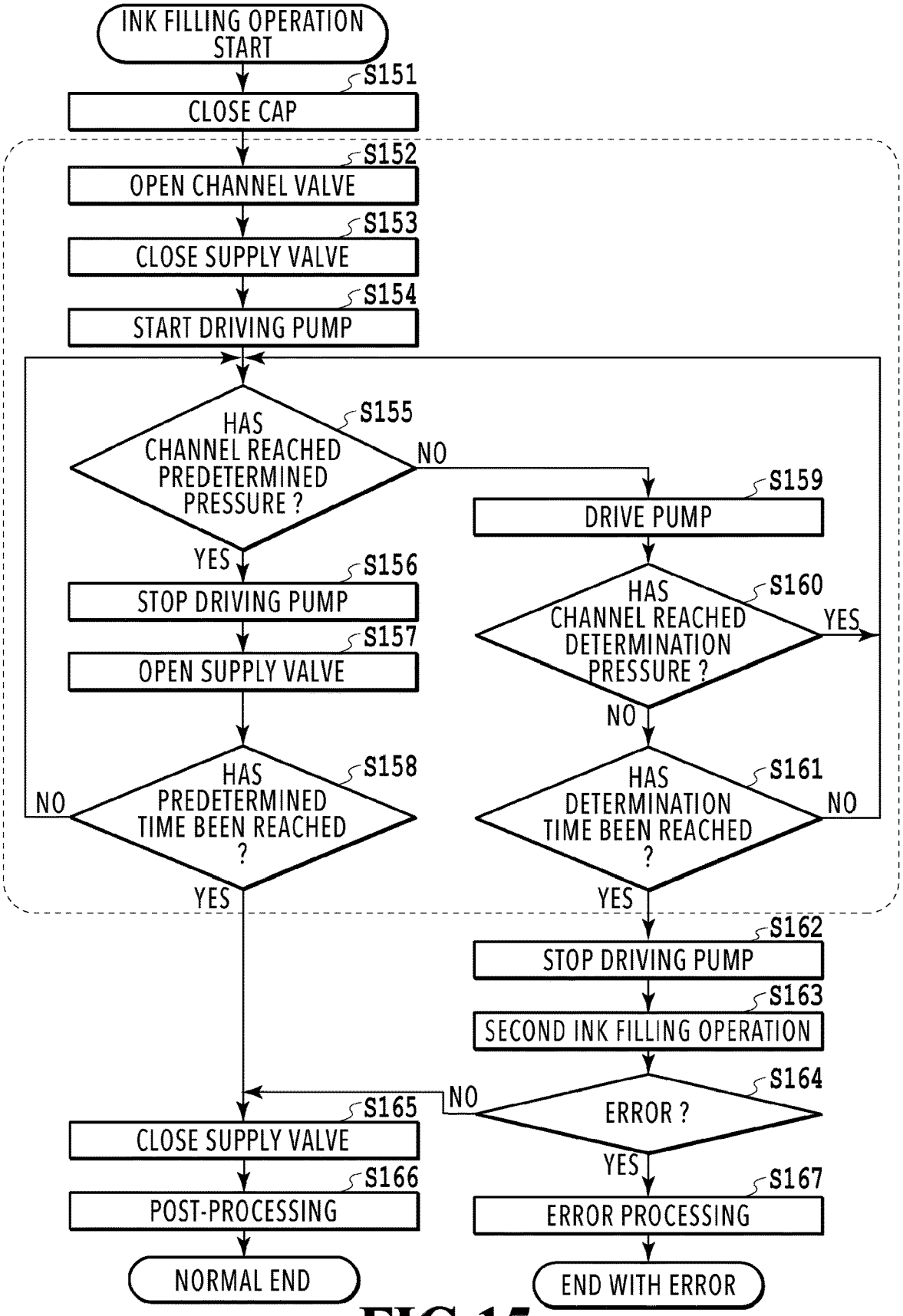
FIG. 15 is a flowchart illustrating processing in ink filling operation.

FIG. 15 is a flowchart illustrating processing in ink filling operation in the present embodiment. The ink filling operation is executed by the print controller 202 using the ink supply control portion 209. The ink filling operation in the present embodiment will be described below with reference to the flowchart.

Upon start of the ink filling operation, in S151, the ejection port surface 8*a* of the print head 8 is caused to abut against the cap member 10*a* to form an enclosed space between the ejection port surface 8*a* and the cap member 10*a*. Thereafter, in S152, the channel valve 110 is opened to bring the channel 113 into an open state. Then, in S153, the second supply valve 114 of the sub tank 90 is closed. The subsequent processing from S154 to S156 and S167 is the same as the processing from S03 to S05 and S14 in the first embodiment (see FIG. 10) and will not be described. When the drive of the channel pump P3 is stopped in S156, the second supply valve 114 is opened in S157, and in S158, whether a predetermined time (45 seconds in the present embodiment) has been reached is determined. If it is determined that the predetermined time has been reached, the processing proceeds to S165 to close the second supply valve 114, and performs post-processing in S166. Details of the post-processing are the same as those in the first embodiment. In addition, second filling operation in the present embodiment is the same as that in the first embodiment.

As seen from the above, in the configuration where the sub tank 90 is provided with the second supply valve 114, if the predetermined negative pressure (determination pressure) is not reached within the predetermined time (determination time) by the normal filling operation, it is assumed that a leakage occurs in the cap member 10*a*, and the second filling operation is performed. This enables provision of an inkjet printing apparatus and an ink filling method capable of performing the ink filling efficiently.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-189651 filed Oct. 5, 2018, which are hereby incorporated by reference wherein in its entirety.

What is claimed is:

1. An inkjet printing apparatus comprising:

a storage unit capable of storing ink;

a print head having an ejection port surface on which ejection ports for ejecting ink supplied from the storage unit are formed;

a supply channel for supplying ink from the storage unit to the print head;

a cap unit capable of covering the ejection port surface;

a depressurizing unit connected to the cap unit and capable of depressurizing a space formed between the ejection port surface and the cap unit in a state where the cap unit covers the ejection port surface;

a channel connecting the cap unit and the depressurizing unit;

a pressure detection unit capable of detecting a pressure of an inside of at least one of the supply channel including the print head and the channel;

a valve unit provided in the channel and capable of opening and closing of the channel; and a control unit capable of performing:

a first filling operation for filling the print head with ink from the storage unit by driving the depressurizing unit with the cap unit covering the ejection port surface and the valve unit being opened; and a second filling operation in which the depressurizing unit is driven, with the ejection port surface covered with the cap unit and the valve unit being closed, and in a case where a pressure of an inside of the channel reaches a second predetermined negative pressure value, the print head is filled with ink from the storage unit by opening the valve unit.

2. The inkjet printing apparatus according to claim 1, wherein the control unit controls to perform the second filling operation in a case where, in the first filling operation, the negative pressure detected by the pressure detecting unit does not reach a first predetermined negative pressure value that is weaker than the second predetermined negative pressure value by driving the depressurizing unit for a predetermined period.

3. The inkjet printing apparatus according to claim 1, further comprising a buffer tank provided in the channel between the depressurizing unit and the valve unit.

4. The inkjet printing apparatus according to claim 3, wherein the pressure detection unit is provided in the buffer tank.

5. The inkjet printing apparatus according to claim 1, wherein the storage unit includes a main tank detachably attached to the apparatus, and a sub tank capable of storing ink supplied from the main tank.

6. The inkjet printing apparatus according to claim 5, further comprising a supply valve capable of shutting off supply of ink from the sub tank to the print head is provided.

7. The inkjet printing apparatus according to claim 6, wherein in the first filling operation, the supply valve is closed, and in a case where the pressure of the inside of the channel reaches a predetermined pressure, the supply valve is opened.

8. The inkjet printing apparatus according to claim 5, further comprising a liquid surface detection unit configured to detect a liquid surface of ink inside the sub tank.

9. The inkjet printing apparatus according to claim 1, further comprising a collection channel for collecting ink from the print head, wherein ink is circulated in a circulation path including the storage unit, the supply channel, the print head, and the collection channel.

10. The inkjet printing apparatus according to claim 9, wherein the print head having a pressure chamber communicating with the ejection port and filled with ink, the circulation path includes the inside of the pressure chamber.

11. The inkjet printing apparatus according to claim 1, wherein the print head is a full line type in which the ejection ports are arranged in an area corresponding to the width of the print medium.

12. An inkjet printing apparatus comprising:

a storage unit capable of storing ink;

a print head including an ejection port surface on which ejection ports for ejecting ink supplied from the storage unit are formed;

a supply channel for supplying ink from the storage unit to the print head;

a cap unit capable of covering the ejection port surface;

a depressurizing unit capable of depressurizing a space formed between the ejection port surface and the cap unit in a state where the cap unit covers the ejection port surface;

a channel connecting the cap unit and the depressurizing unit;

a pressure detection unit capable of detecting a pressure of an inside of at least one of the supply channel including the print head and the channel;

a valve unit provided in the channel and capable of opening and closing the channel; and a control unit capable of performing:

a first suction operation in which the depressurizing unit is driven, with the ejection port surface covered with the cap unit and the valve unit opened, so as to depressurize the space and an inside of the print head; and a second suction operation in which the depressurizing unit is driven, with the ejection port surface covered with the cap unit and the valve unit being closed, and in a case where a pressure of an inside of the channel reaches a predetermined pressure, the valve unit is opened, so as to depressurize the space and the inside of the print head.

13. An ink filling method, comprising:

a capping step of covering an ejection port surface of a print head with a cap unit, the ejection port surface being formed with ejection ports for ejecting ink supplied from a storage unit configured to store ink;

a depressurizing step of depressurizing a space that is formed by the ejection port surface and the cap unit when the ejection port surface is covered in the capping step, and a connecting space that is formed by a channel connected to the cap unit;

a pressure detecting step of detecting a pressure of an inside of the channel;

a closing step of closing the channel with a valve provided in the channel, wherein the following operations are performed;

a first filling step of filling the print head with ink from the storage unit by depressurizing the inside of the print head with the ejection port surface covered with the cap unit and the valve opened; and a second filling step of filling the print head with ink by opening the valve after the pressure of an inside of connection space reaches a predetermined pressure by the depressurizing step in a state where the ejection port surface is covered with the cap unit and the valve closed.

* * * * *